US010099913B2

(12) United States Patent
Oostveen

(10) Patent No.: US 10,099,913 B2
(45) Date of Patent: Oct. 16, 2018

(54) SUMP BASE DISPENSING SYSTEM FOR BULK BIN AND BAG COMBINATION

(71) Applicant: INTERNATIONAL PAPER COMPANY, Memphis, TN (US)

(72) Inventor: Elmar Oostveen, Amsterdam (NL)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 15/277,302

(22) Filed: Sep. 27, 2016

(65) Prior Publication Data

US 2017/0088411 A1 Mar. 30, 2017

Related U.S. Application Data

(60) Provisional application No. 62/233,613, filed on Sep. 28, 2015.

(51) Int. Cl.
*B65D 77/06* (2006.01)
*B67D 3/00* (2006.01)

(52) U.S. Cl.
CPC ..... *B67D 3/0067* (2013.01); *B65D 77/061* (2013.01); *B65D 77/065* (2013.01)

(58) Field of Classification Search
CPC .... B65D 77/061; B65D 77/065; B65D 77/30; B67D 3/0067; B67D 3/0083; B67D 3/04; B67D 2001/0827; B67D 1/0004
USPC ..... 222/573, 105, 538, 185.1; 220/495.05
See application file for complete search history.

(56) References Cited

U.S. PATENT DOCUMENTS

| | | | | |
|---|---|---|---|---|
| 3,448,897 | A | 6/1969 | Sterling | |
| 4,786,192 | A | 11/1988 | Graves | |
| 4,850,506 | A * | 7/1989 | Heaps, Jr. | B65D 77/061 206/386 |
| 5,813,562 | A | 9/1998 | Perkins | |
| 8,002,145 | B2 * | 8/2011 | Anjos | B65D 77/061 206/509 |
| 2005/0040063 | A1 | 2/2005 | Churvis | |
| 2006/0175385 | A1 | 8/2006 | McDowell | |
| 2011/0017731 | A1 | 1/2011 | Taravella | |
| 2012/0318824 | A1 | 12/2012 | McKenna | |
| 2014/0231689 | A1 | 8/2014 | Knutsson | |

FOREIGN PATENT DOCUMENTS

| | | |
|---|---|---|
| DE | 202014007695 | 11/2012 |
| WO | 93/24396 | 12/1993 |

* cited by examiner

*Primary Examiner* — Patrick M Buechner
*Assistant Examiner* — Robert Nichols, II

(57) ABSTRACT

A sump base dispensing system for dispensing a flowable material includes a bulk bin container having a bottom wall and a plurality of upstanding side walls foldably joined to the bottom wall to form an interior space. One of the plurality of the side walls includes a dispensing opening. A cassette is configured to be disposed into the interior space bulk bin container and is positioned within the bottom wall of the bulk bin container. The cassette includes a product bag having a respective inlet and outlet ports used for respective filling and dispensing the flowable material from the product bag. A sump base dispensing apparatus is configured to be attached to the product bag via a dispensing fitment so as to assist in removing the flowable material residual through the dispensing fitment by gravity force.

16 Claims, 24 Drawing Sheets

SUMP BASE DISPENSING SYSTEM FOR BULK BIN AND BAG COMBINATION

CROSS REFERENCE TO RELATED APPLICATIONS

This application claims priority to U.S. Provisional Patent Application Ser. No. 62/233,613, filed on Sep. 28, 2015, which is hereby incorporated hereinto by reference as if fully restated herein.

TECHNICAL FIELD

The present specification generally relates to bulk shipping containers and more particularly, to a sump base dispensing apparatus used in a bulk bin container and bag combination or bag-in-box for storage and dispensing of a flowable material. The bag-in-box as known in the art is type of a container for the storage and transportation of liquid or semi-liquid material.

BACKGROUND

Container and/or bulk container is a container used for transport and storage of fluids and bulk materials. The bulk containers are also known as intermediate bulk container (IBC), bulk bin container, tote, bulk bin, and/or bulk shipping container which are all used for the transport and storage of fluids and other flowable bulk materials such as liquid or semi-liquid materials. The bulk containers are generally cubic in form and therefore can transport more material in the same area than cylindrically shaped containers. The bulk containers generally rely on flexible materials such as plastic bags that can be filled and dispensed with a variety of systems. Sometimes the plastic bags can be replaced by a plastic liner that is attached to the bulk container. One particularly suitable bulk bin container is sold by International Paper Company under the trademark SpaceKraft® or ReadyFill®. The plastic bag may typically contain between 220 to 330 gallons of flowable materials or other quantities of the flowable materials depending on the specific use thereof. The plastic bag is supported inside the bulk bin for containing flowable materials. When filling the plastic bag with a flowable material, a filling valve is attached to its upper end to pour in the material and then the plastic bag is sealed with a removable cap. The plastic bag has a dispensing fitment apparatus that is used to dispense the flowable material such as liquids or semi-liquid from the plastic bag. The bulk bin container has a generally circular opening in one of the sidewalls that complement the dispensing fitment apparatus. The generally circular opening is typically located above the bottom wall of the bulk bin container. To dispense the flowable material from the plastic bag, the bulk bin container is typically placed on a level floor or level deck or stand so that the liquid is dispensed by the gravity force. However, dispensing the flowable material by way of gravity force can cause some residual material being left in the bag since the dispensing fitment is located above the bottom of the bulk bin container and therefore, the residual material can no longer being able to be dispensed by the gravity force which is an expensive waste and a disposal issue.

Accordingly, a need exists for an affordable, functional bulk bin container having a sump base dispensing apparatus for discharging flowable materials from the bulk bin container and is free from the disadvantages of the aforementioned dispensing system

SUMMARY

In one embodiment, a sump base dispensing system for dispensing a flowable material is provided. The sump base dispensing system includes a bulk bin container having a bottom wall and a plurality of upstanding side walls foldably joined to the bottom wall to form an interior space. One of the plurality of the side walls includes a dispensing opening. A cassette is configured to be disposed into the interior space and is positioned within the bottom wall of the bulk bin container. The cassette includes a product bag having a respective inlet and outlet ports used for respective filling and dispensing the flowable material from the product bag. A sump base dispensing apparatus is configured to be attached to the product bag via a dispensing fitment so as to assist in removing the flowable material residual through the dispensing fitment by gravity force.

In another embodiment, a sump base dispensing system for dispensing flowable material from a bulk bin container is provided. The sump base dispensing system includes a bulk bin container having a bottom wall and a plurality of upstanding side walls foldably joined to the bottom wall to form an interior space. The bottom wall includes a recess formed therein and one of the plurality of the side walls includes a dispensing opening. A product bag is configured to be disposed into the interior space of the bulk bin container. The product bag includes a respective inlet and outlet ports used for respective filling and dispensing the liquid from the product bag. A dispensing fitment is attached to the outlet port and is inserted into the dispensing opening of the bulk bin container. A sump base dispensing apparatus is configured to be attached to the dispensing fitment. The sump base dispensing apparatus includes a sump tray and a locking bracket in which the sump tray is configured to be mounted in a hanging-down position from the recess of the bottom wall of the bulk bin container. The locking bracket is configured to be attached to the sump tray via the dispensing fitment held therebetween so as to assist in removing the liquid leftover through the dispensing fitment by gravity force.

In a further embodiment, a cassette kit for a bulk bin container for dispensing flowable material is provided. The kit includes a cassette board tray and a product bag which is removably attached to the cassette board tray. The product bag includes a respective inlet and outlet ports used for respective filling and dispensing the flowable material from the product bag. A dispensing fitment is attached to the outlet port and a sump base dispensing apparatus is configured to be attached to the product bag via the dispensing fitment so as to assist in removing the flowable material through the dispensing fitment by way of gravity force.

In yet another embodiment, a sump base dispensing kit for a bulk bin container and bag combination for dispensing flowable material from the bulk bin container and bag combination is provided. The kit includes a sump tray and a locking bracket that is attached to the sump tray. The sump tray is configured to be mounted in a hanging-down position from a recess in the bulk bin container and the locking bracket is configured to be attached to the sump tray with a dispensing fitment held therebetween so as to assist in removing the flowable material through the dispensing fitment by gravity force.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

FIGS. 3A-3C depict the sump base dispensing apparatus comprising a locking bracket in a spaced apart relation with a sump tray, wherein FIG. 3A illustrates the locking bracket, the dispensing fitment and the sump tray in an un-assembled position, FIG. 3B illustrates the locking bracket, the dispensing fitment, and the sump tray in an assembled position, and FIG. 3C illustrates the locking bracket and the dispensing fitment folding back and laying down inside of the interior space of the sump tray according to one or more embodiments shown and described herein.

DETAILED DESCRIPTION

Embodiments described herein are generally related to a sump base dispensing system. The sump base dispensing system may comprise a cassette having a product bag, a sump base apparatus, and a dispensing fitment being attached to one another. It is noted that the instant disclosure may be applied to any bulk material container such as bulk bin, bulk bin container, bulk shipping container, and intermediate bulk container (IBC).

Figure 1:
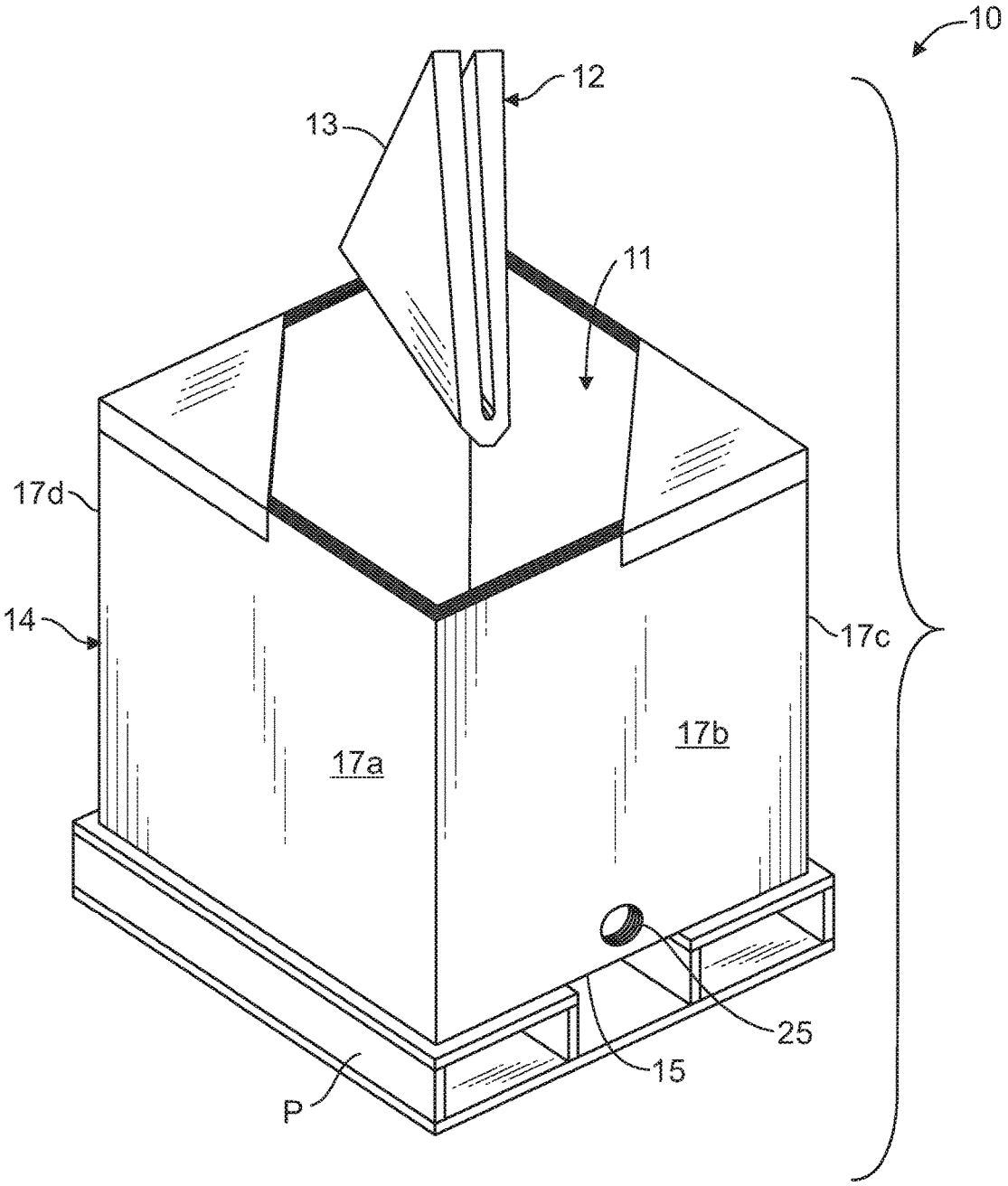
FIG. 1 illustrates a top perspective view of a sump base dispensing system having a bulk bin container and a cassette in a spaced apart relationship with one another which is positioned on a pallet and wherein the cassette is in a folded position according to one or more embodiments shown and described herein.

Referring to FIG. 1, the sump base dispensing system 10 comprises a bulk bin container 14 and a cassette 12 in a spaced apart relationship with one another. The bulk bin container 14 includes a bottom wall 15, a plurality of side walls foldably joined to one another to form an interior space 11. The plurality of side walls is defined, as non-limiting example, by four upstanding side walls 17*a*, 17*b*, 17*c*, and 17*d* each of which is foldably joined to the bottom wall 15. One of side walls, such as side wall 17*b*, includes a dispensing opening 25 formed therein near the fold line separating the side wall 17*b* and the bottom wall 15 from one another. As one of ordinary skill in the art would appreciate that the dispensing opening 25 may be formed on any of the side walls 17*a*, 17*c*, and 17*d*. As an example shown in FIG. 1, the sump base dispensing system 10 is positioned on a pallet P. However, it is within the scope of the instant disclosure to position the sump base dispensing system 10 on any elevated surface including a horizontal or slightly tilted surface to dispense the flowable material from the sump base dispensing system 10. The flowable materials can be, among others, liquid, semi-liquid and flowable solids.

Figure 2:
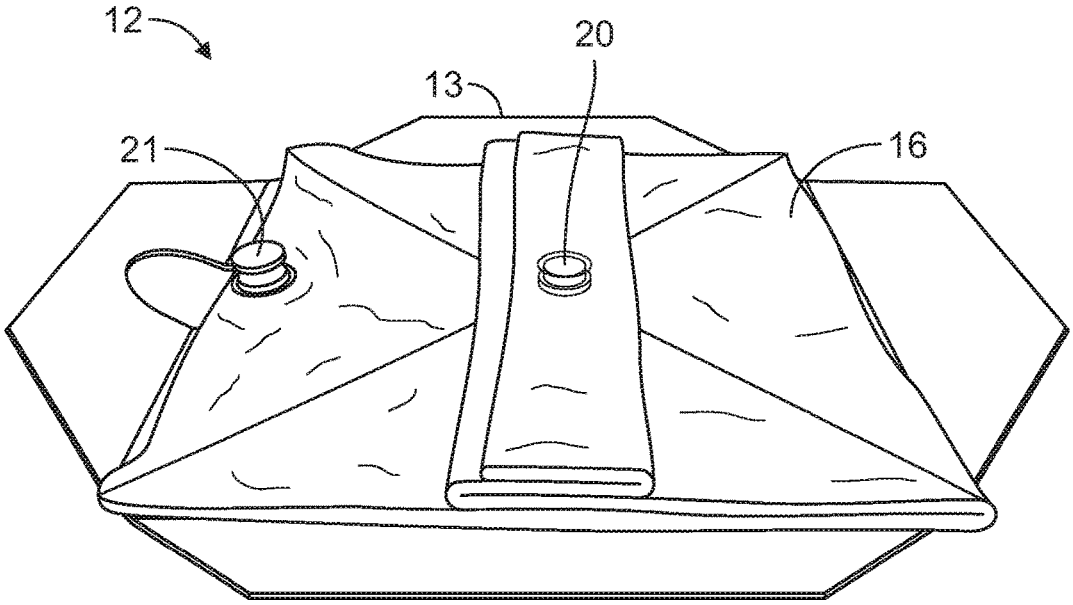
FIG. 2 illustrates a top perspective view of the cassette of FIG. 1 illustrating the cassette in an unfolded position wherein the cassette comprises a cassette board tray containing a product bag and in which a sump base dispensing apparatus and a dispensing fitment are concealed under the product bag according to one or more embodiments shown and described herein.

Referring to FIG. 2, the cassette 12 in illustrated an unfolded or exposed position. In one exemplary embodiment, the cassette 12 comprises a cassette board tray 13 containing a product bag 16 having respective inlet and outlet ports 20, 21 for filling and dispensing flowable material, respectively. As will be discussed in greater detail hereinafter, a sump base dispensing apparatus 18 and a dispensing fitment 22 are concealed under the product bag 16 in a flat or knock down position. The cassette 12 may comprise a modular unit that can be used with other various bulk containers or other dispensing system. The product bag 16 in one embodiment can be adhesively, or other attaching means, attached to the cassette board tray 13.

Figure 3A:
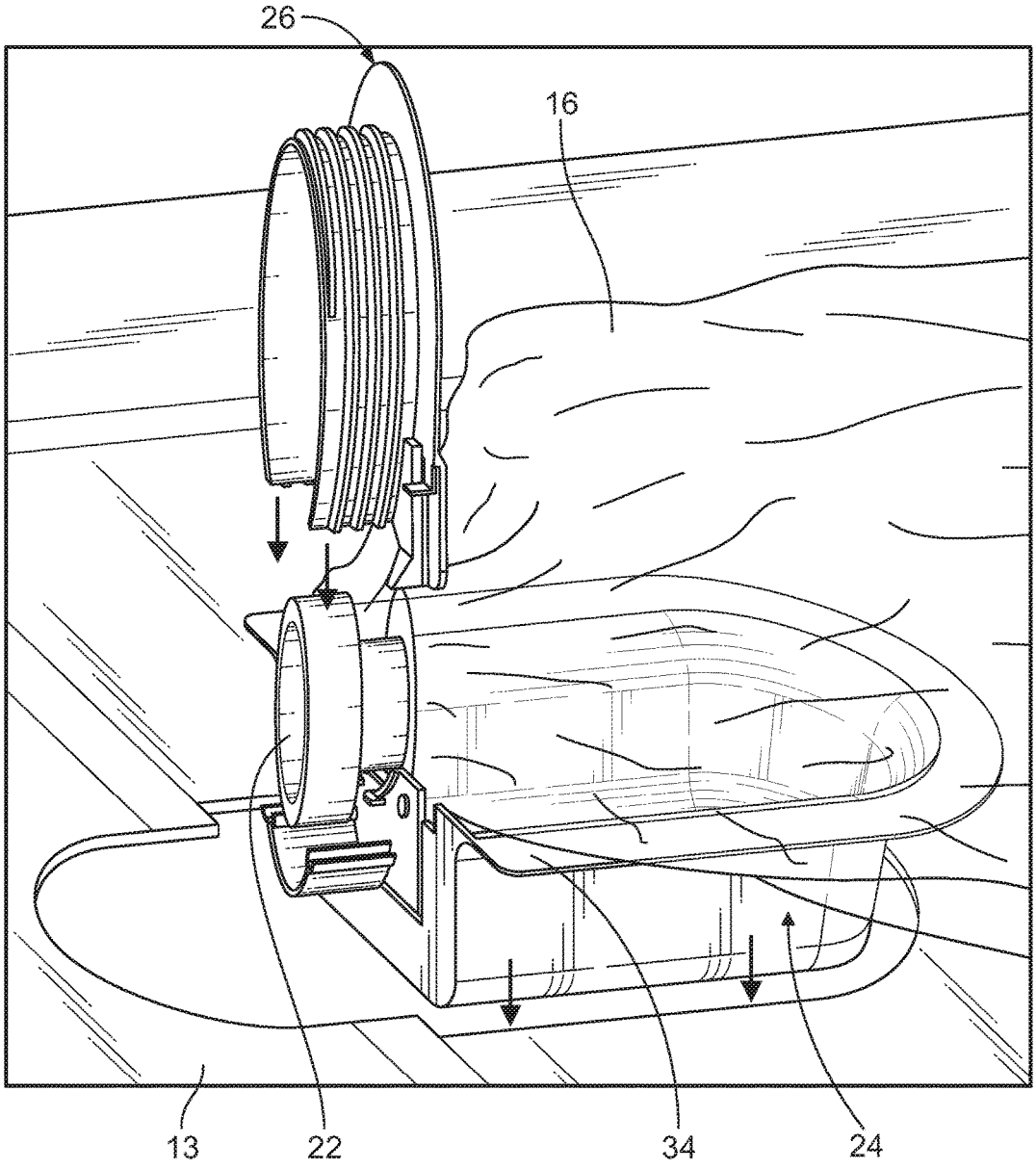
Figure 3B:
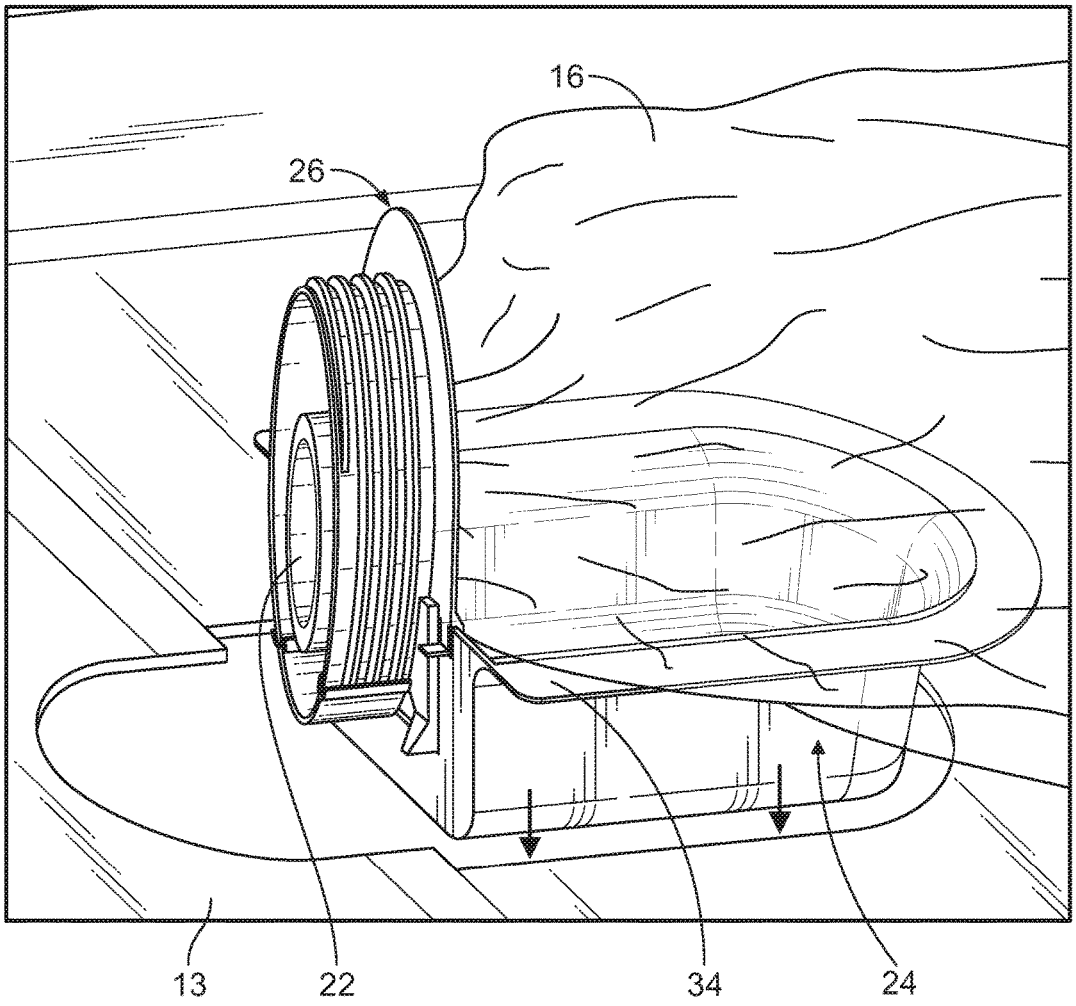
Figure 3C:
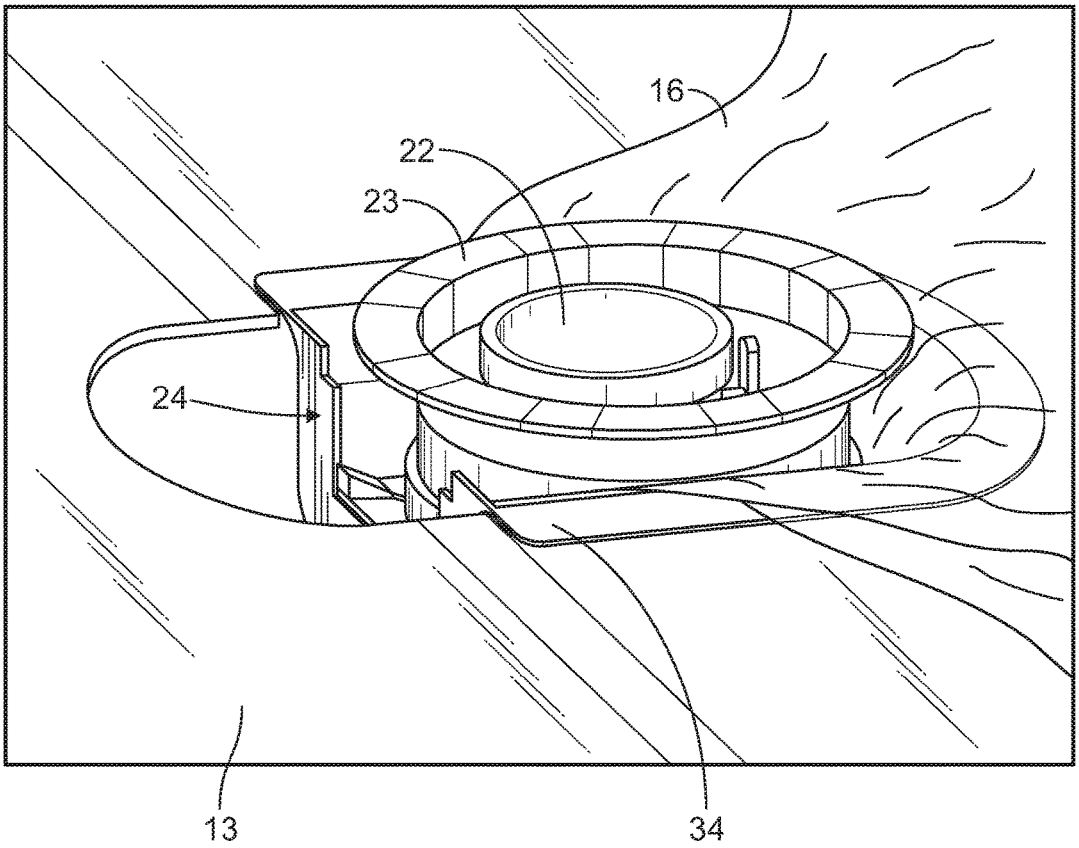

Referring to FIG. 3A, which illustrates the sump base dispensing apparatus 18 and a locking bracket 26 in a spaced apart relation with a sump tray 24 in an un-assembled position with the dispensing fitment 22 therebetween. The dispensing fitment 22 is attached to the outlet port 21 of the product bag 16, and is engaged with the sump tray 24 and the locking bracket 26 so that the dispensing fitment 22 is securely hold in place as depicted in FIG. 3B. Furthermore, the sump tray 24 is engaged with the cassette board tray 13 through a mounting surface 34. As noted hereinbefore, the sump base dispensing apparatus 18 including the dispensing fitment 22 are part of the cassette 12 and in one embodiment fit within the cassette 12 and are folded within the cassette 12 as one modular unit during shipping and transportation. For doing so, the locking bracket 26 and the dispensing fitment 22 are sized, shaped and constructed so that they can be fold back and lay down inside of the interior space of the sump tray as seen best in FIG. 3C.

Figure 4:
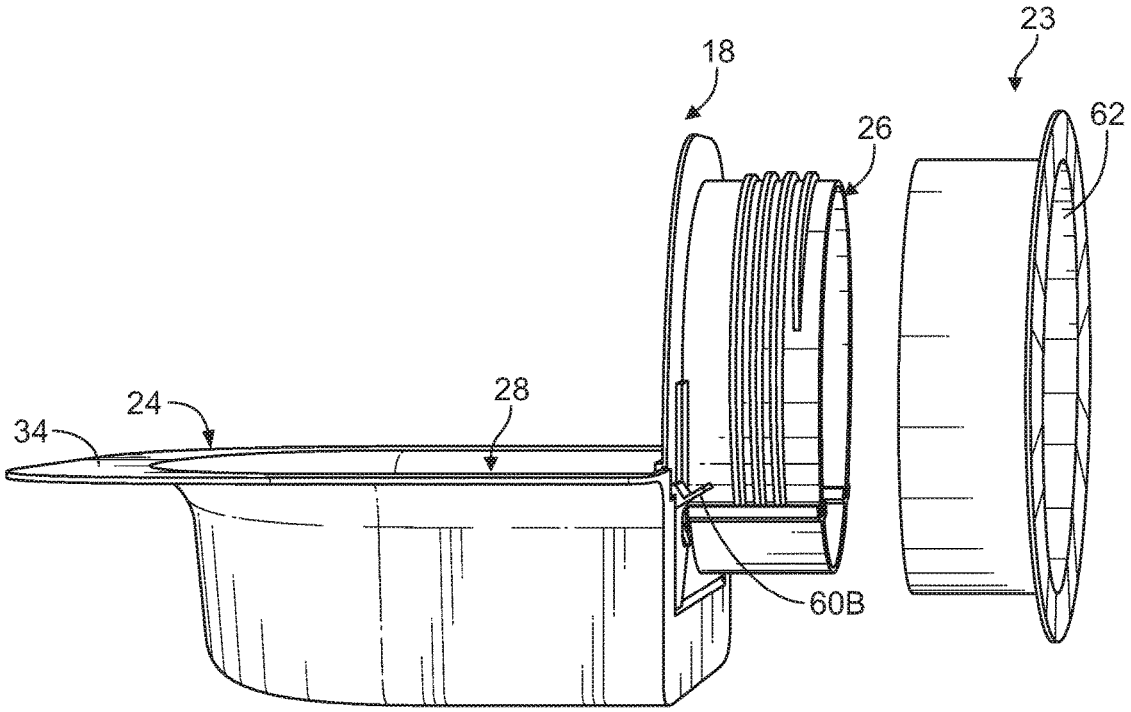
FIG. 4 illustrates an exploded perspective view of the sump base dispensing apparatus and a lock nut according to one or more embodiments shown and described herein.

Referring to FIG. 4, the sump base dispensing apparatus 18 and a lock nut 23 are in a spaced apart relationship. As noted hereinbefore, the sump base dispensing apparatus 18 is part of cassette 12 and therefore, the lock nut 23 is used to attach the sump base dispensing apparatus 18 to the bulk bin container 14. As noted hereinabove, the sump base dispensing apparatus 18 comprises the locking bracket 26 and the sump tray 24 which is engaged with the bottom wall 15 of bulk bin container 14 via the mounting surface 34 as will be described in greater detail hereinafter. In one embodiment, the luck nut 23 is engaged with the locking bracket 26 to securely attach the sump base dispensing apparatus 18 with the bulk bin container 14, however, it is within the scope of the instant disclosure to use alternative means of attachment for engaging the sump base dispensing apparatus 18 with the bulk bin container 14.

Figure 5A:
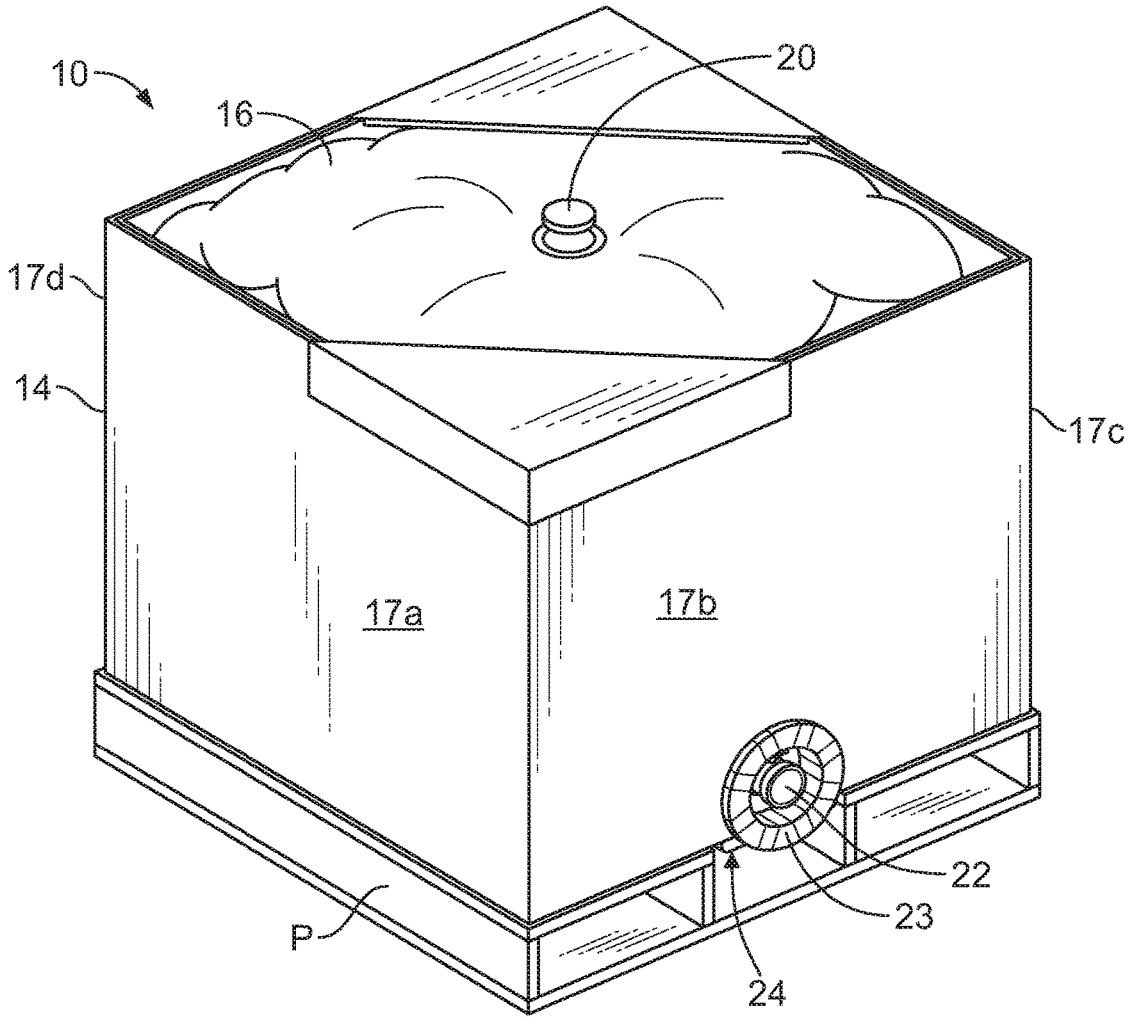
FIG. 5A illustrates a top perspective view of the sump base dispensing system shown in FIG. 1 with the cassette disposed therein and the product bag is filled with flowable material according to one or more embodiments shown and described herein.
Figure 5B:
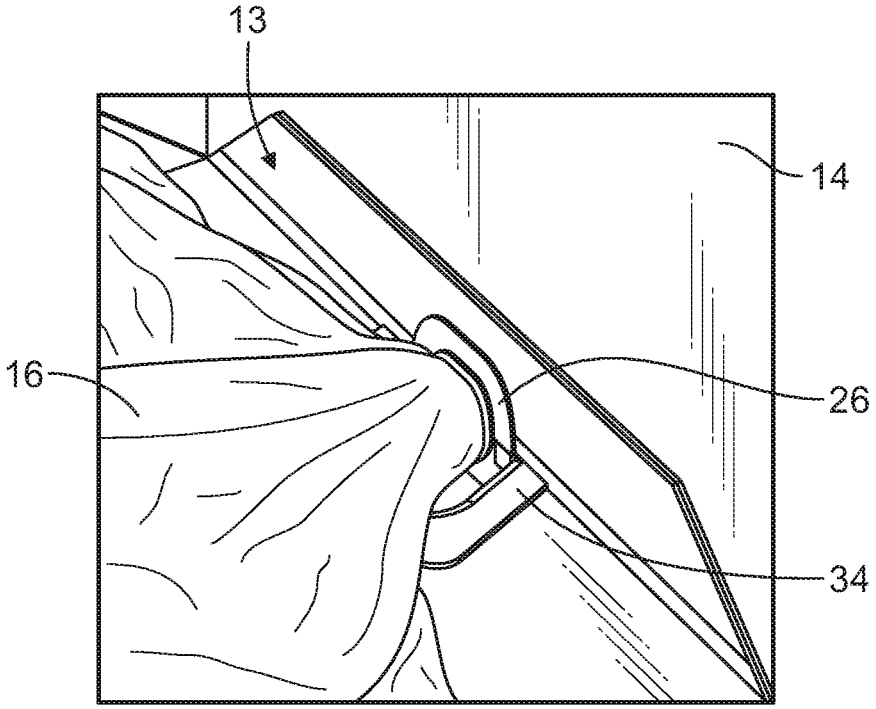
FIG. 5B depicts a view inside the sump base dispensing system of FIG. 1 and illustrates the manner in which the cassette is positioned therein before the sump base dispensing system is filled with flowable material according to one or more embodiments shown and described herein.
Figure 5C:
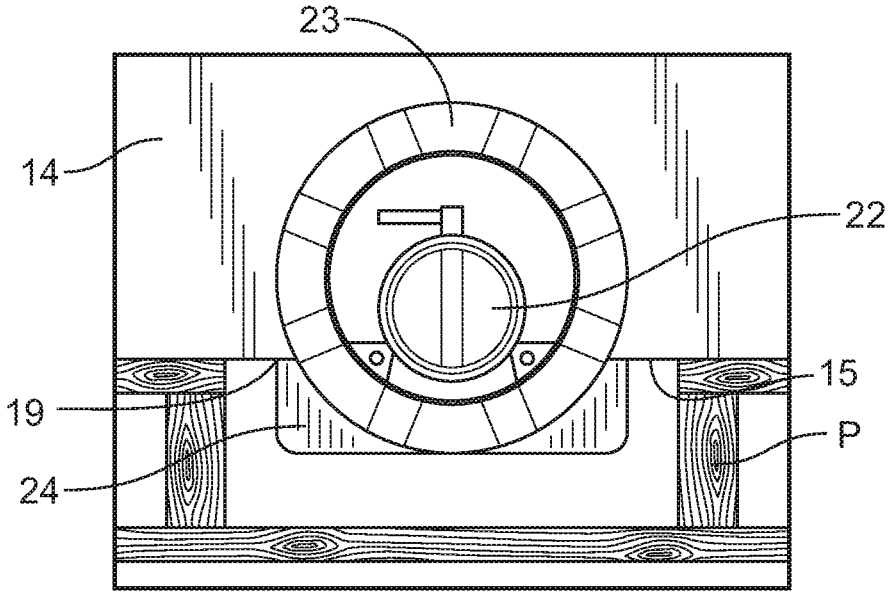
FIGS. 5C and 5D illustrate enlarged views of a front portion of the sump base dispensing system of FIG. 5A depicting a lock nut used to attach the sump base dispensing apparatus and the dispensing fitment to the bulk bin container and the sump tray is in a hanging-down position from a recess formed in the bottom wall of the bulk bin container according to one or more embodiments shown and described herein.
Figure 5D:
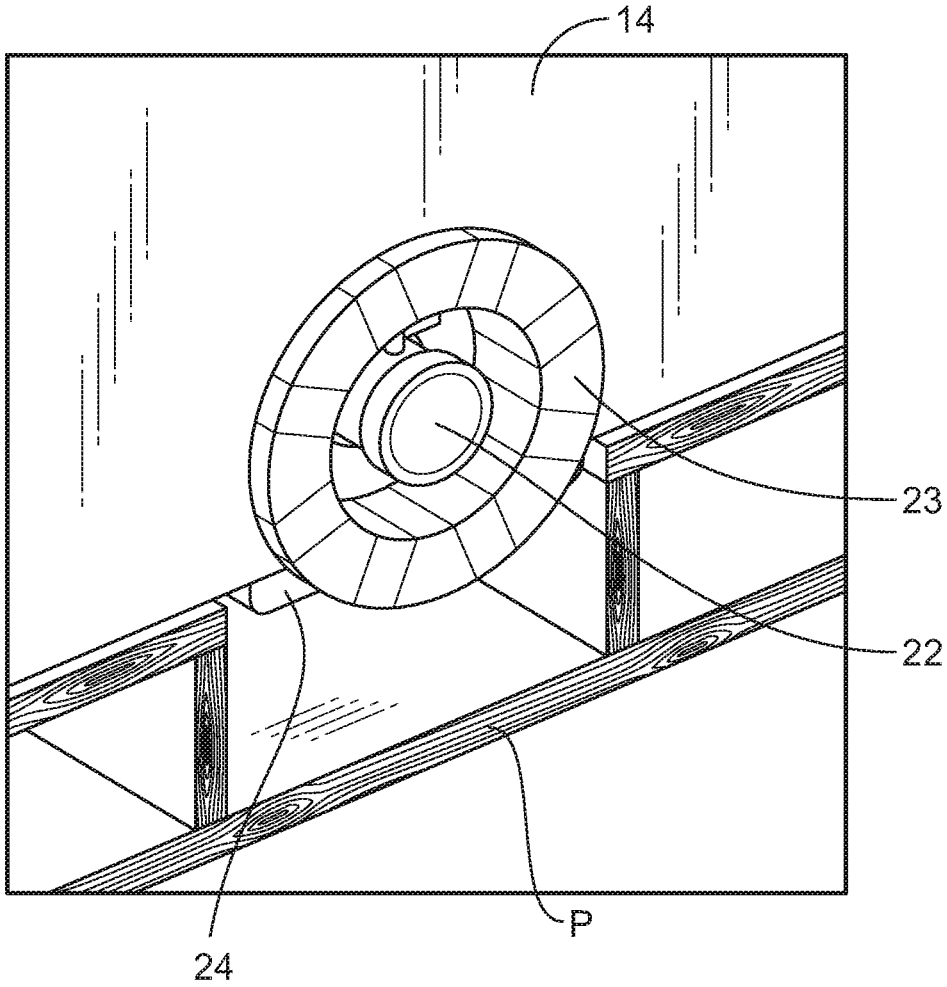

Referring to FIG. 5A, the sump base dispensing system 10 and the product bag 16 is filled with flowable material. Before filling the product bag 16 with the flowable material, the cassette 12 is disposed into the interior 11 of the bulk bin container 14 such that the cassette board tray 13 is laid down on the bottom wall 15 of the bulk bin container 14 as depicted in FIG. 5B. The sump base dispensing system 10 is configured to be positioned on a pallet P so that the sump tray 24 is hanging-down below the bottom wall 15 of the bulk bin container 14 as seen best in FIGS. 5C and 5D. Although the pallet P is used as a means of support for the sump base dispensing system 10, any other support means can be used which allow the sump tray 24 to be positioned below the bottom wall of the bulk bin container 14 without impediment. The bottom wall 15 includes a recess 19 formed therein so that sump tray 24 can be disposed into the recess 19 and be supported by the bottom wall 15 vis mounting surface 34 as depicted in FIGS. 5B and 5C. The shape and size of recess 19 corresponds to the shape and size of the sump tray 24. The lock nut 23 may be used to attach the sump base dispensing apparatus 18 to the bulk bin container 14 via the locking bracket 26 as shown in FIGS. 4 and 5D. The sump base dispensing apparatus 18 is configured to be attached to the dispensing fitment 22 of the product bag 16 so as to assist in maximizing the removal of the flowable material through the dispensing fitment 22 by the gravity force.

In one embodiment, the sump base dispensing system 10 is defined by a combination of bulk bin container 14 and product bag 16 receiving the sump base dispensing apparatus 18, and the dispensing fitment 22. The bulk bin container 14 is comprised of rigid materials and the product bag 16 is made of suitable flexible material such as polymer and/or plastic. One particularly suitable container for forming the rigid bulk bin container is sold by International Paper Company under the trademark SpaceKraft®. The bulk bin container 14 can be made from a continuously wound sleeve of linerboard and corrugated medium. Similarly, the cassette board tray 13 may also be made of corrugated paperboard. However, one of ordinary skilled in the art would appreciate that the instant disclosure may also be used with other outer rigid bulk bin container. As noted, in one embodiment, the product bag 16 is generally made of polymer such as, as non-limiting example, low density food grade polyethylene or other similar materials that can operate effectively from −20° C. to more than +40° C. It should be noted that other polymer materials in addition to polyethylene are within the scope of the instant disclosure. The product bag 16 may be supported inside the bulk bin container 14 for containing flowable materials. When filling the product bag 16 with flowable material, a filling valve (not shown) is attached to the inlet port 20 to fill the flowable material in the product bag 16 and then the product bag 16 is sealed with a removable cap.

In one embodiment, the dispensing fitment 22 is attached to the outlet port 21 of the product bag 16. The standard dispensing fitment on the product bag 16 has, as a non-limiting example, a 2" British Standard Pipe (BSP) thread. The dispensing fitment 22 is generally made of a polyethylene material so that it can be welded to the polyethylene film used to construct the product bag 16. It should be noted that other materials in addition to the polyethylene material can be used to make the dispensing fitment 22. As noted above, the lock nut 23 is used to attach the sump base dispensing apparatus 18 to the bulk bin container 14.

Figure 6A:
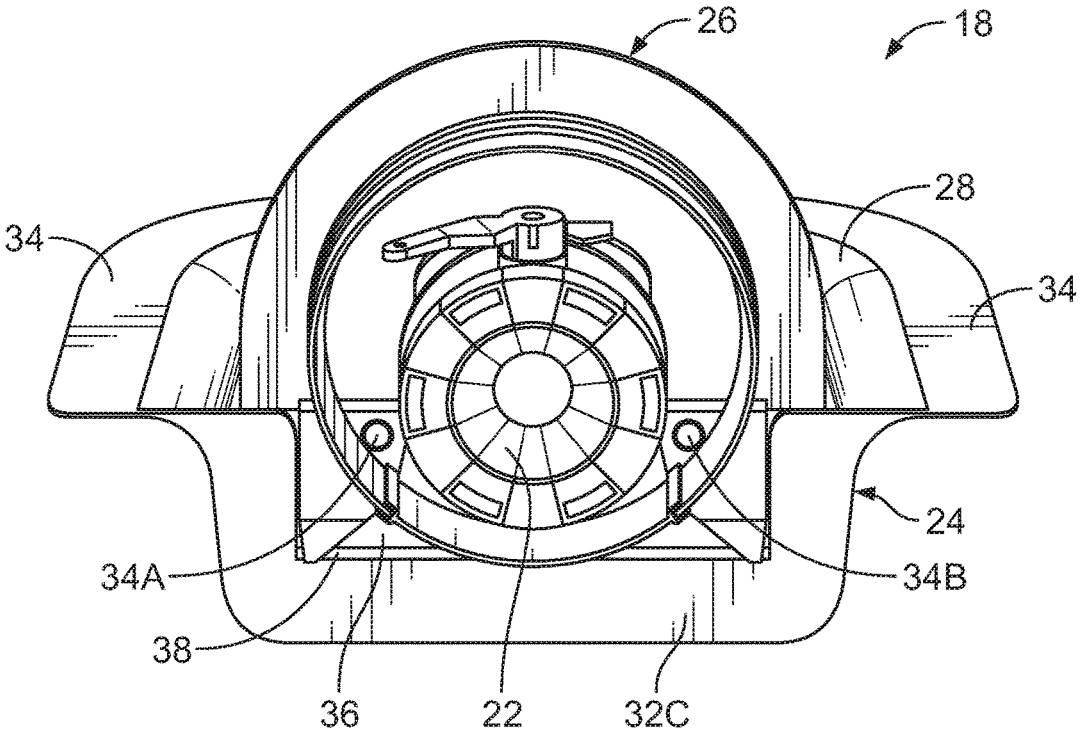
FIG. 6A illustrates a top perspective view of the sump base dispensing apparatus including the dispensing fitment being used with the sump base dispensing system of FIG. 1 according to one or more embodiments shown and described herein.
Figure 6B:
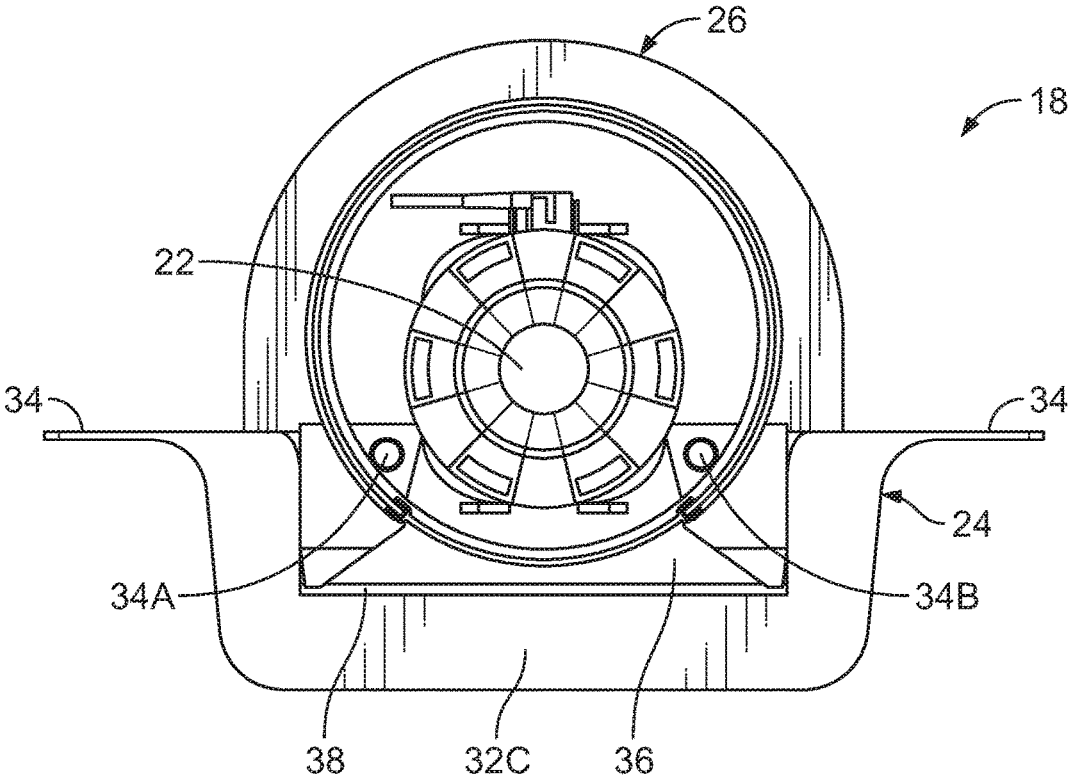
FIG. 6B illustrates a front view of the sump base dispensing apparatus including the dispensing fitment shown in FIG. 6A according to one or more embodiments shown and described herein.
Figure 6C:
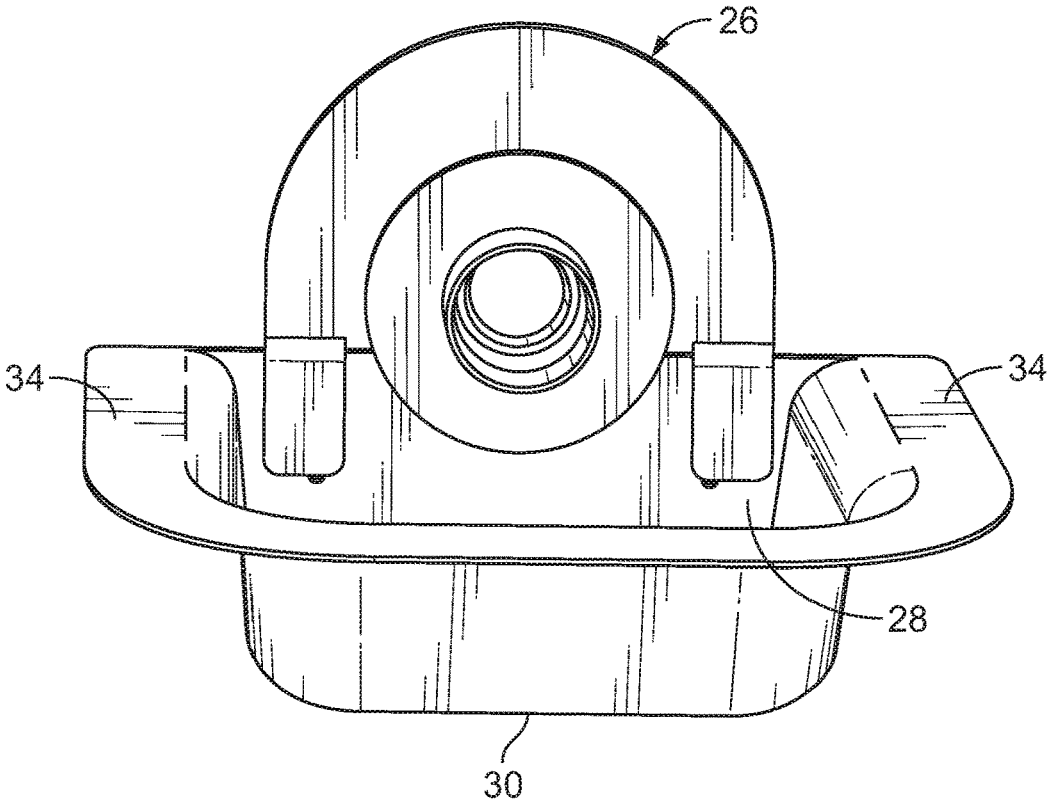
FIG. 6C illustrates a back view of the sump base dispensing apparatus including the dispensing fitment shown in FIG. 6A according to one or more embodiments shown and described herein.
Figure 6D:
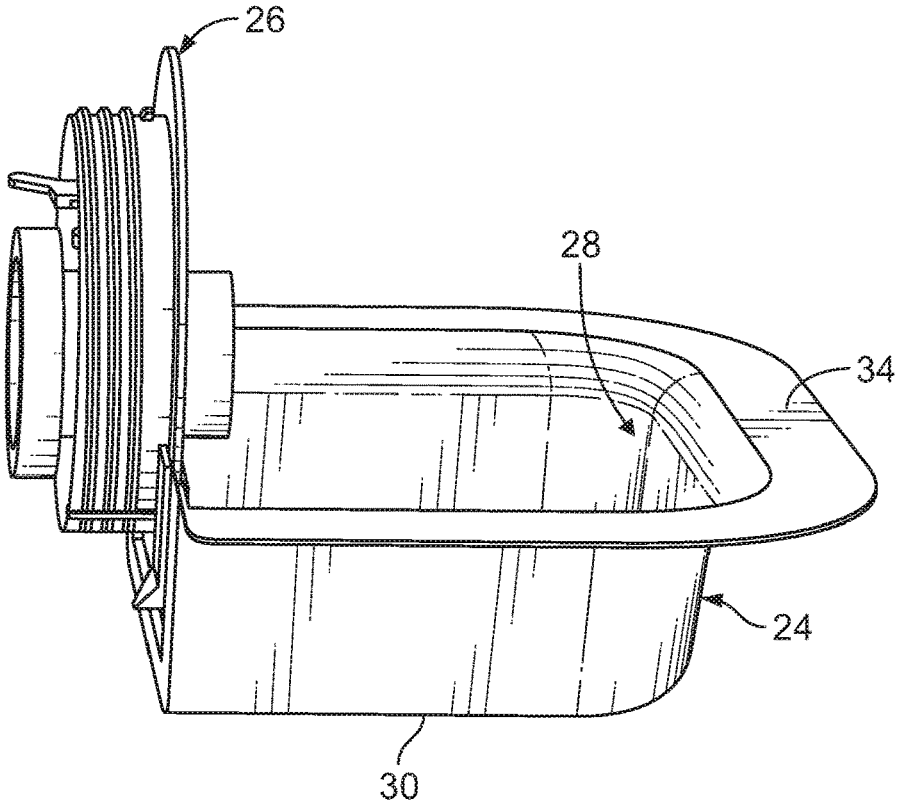
FIG. 6D illustrates a side view of the sump base dispensing apparatus including the dispensing fitment shown in FIG. 6A according to one or more embodiments shown and described herein.

Referring now to FIG. 6A, which the sump base dispensing apparatus 18 comprises a dispensing fitment 22 being used with the sump base dispensing system 10. FIGS. 6B-6D illustrate the respective front, back and side views of the sump base dispensing apparatus 18 depicted in FIG. 6A. The sump base dispensing apparatus 18 may include a sump tray 24 and a locking bracket 26 that can be used to securely hold in place the dispensing fitment 22. Since the dispensing fitment 22 is attached to the outlet port of the product bag 16, then the sump tray 24 and the locking bracket 26 are indirectly attached to the product bag 16. The sump tray 24 includes an interior space 28 that is used to receive the combination of dispensing fitment 22 and the locking bracket 26 in a folded position so that the sump base dispensing apparatus 18 can be nested inside the cassette 12. In one exemplary embodiment, the dimensions of the interior space 28 are designed and constructed so that a minimum amount of flowable material can be contained therein, but yet large enough to contain the sump base dispensing apparatus 18 therein.

Figure 7A:
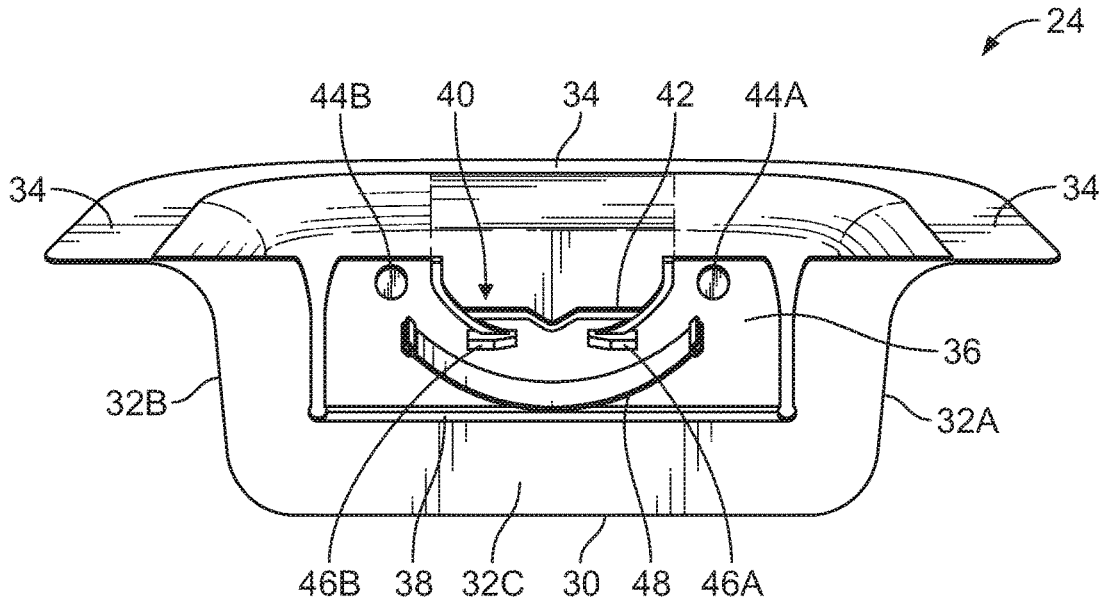
FIG. 7A illustrates a front view of the sump tray shown in FIG. 6A with the locking bracket and the dispensing fitment being detached from the sump tray according to one or more embodiments shown and described herein.
Figure 7B:
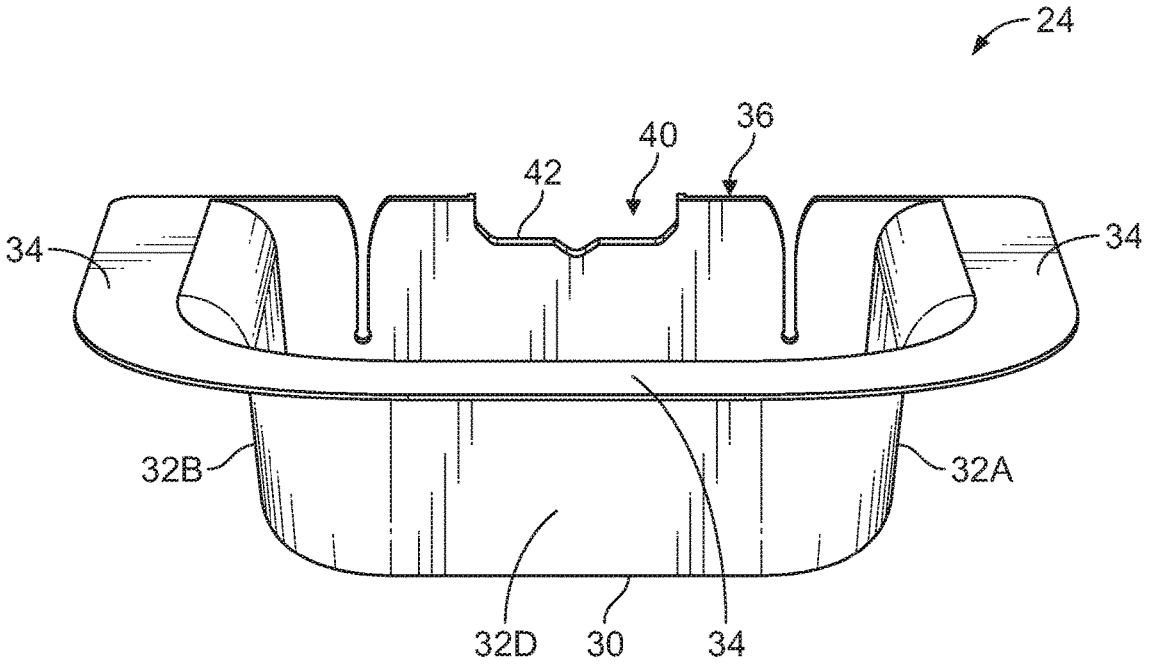
FIG. 7B illustrates a back view of the sump tray shown in FIG. 7A according to one or more embodiments shown and described herein.
Figure 7C:
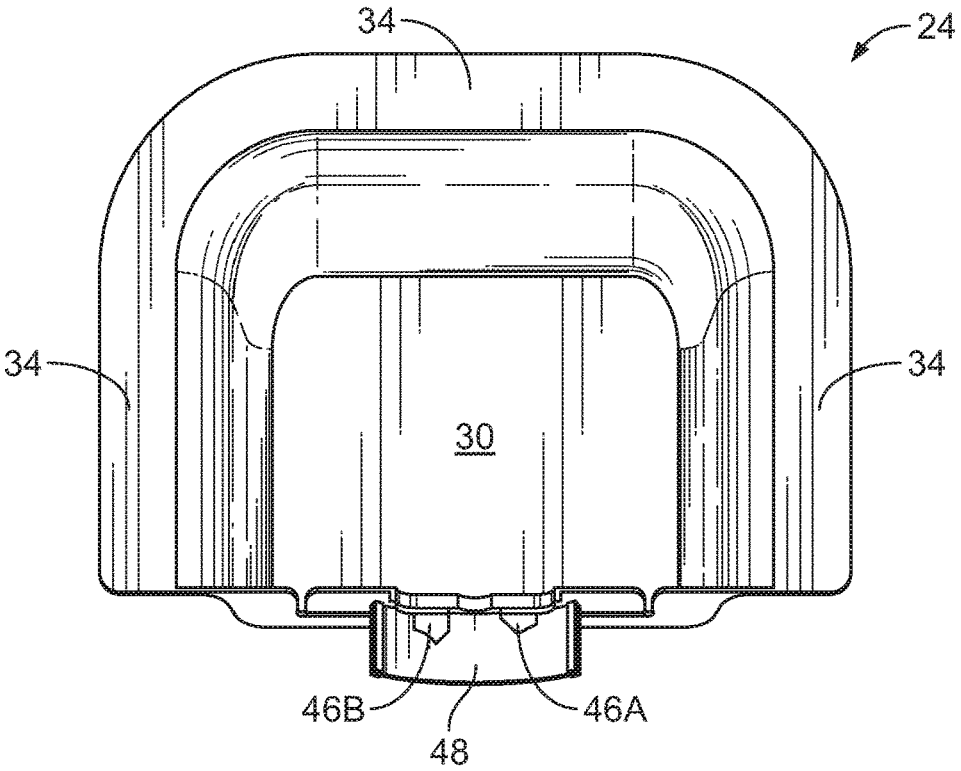
FIG. 7C illustrates a top view of the sump tray shown in FIG. 7A according to one or more embodiments shown and described herein.
Figure 7D:
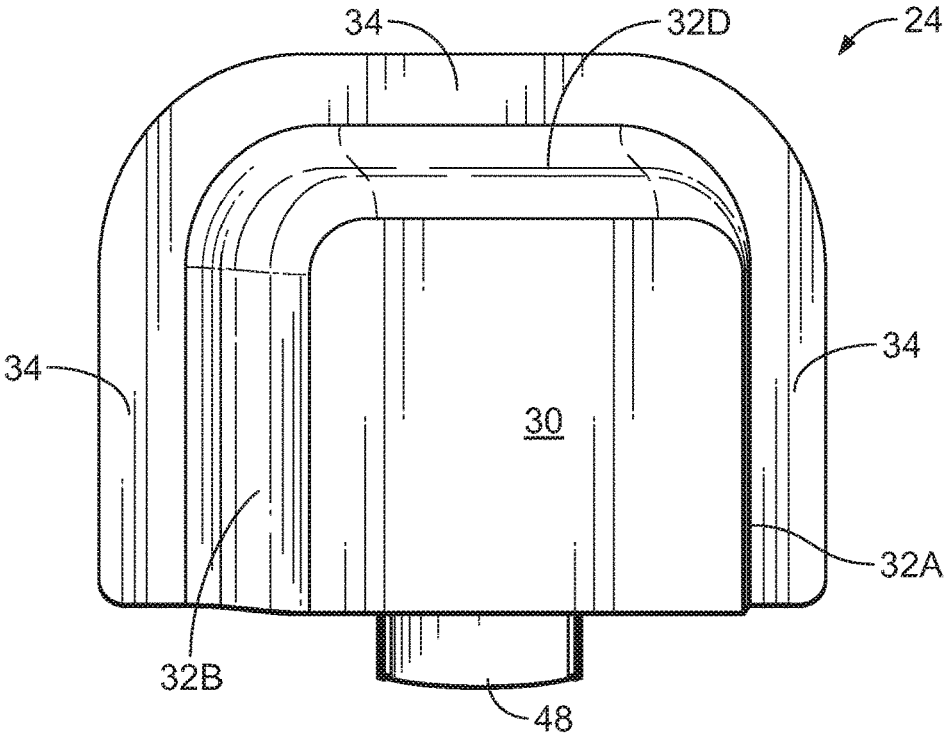
FIG. 7D illustrates a bottom view of the sump tray shown in FIG. 7A according to one or more embodiments shown and described herein.
Figure 7E:
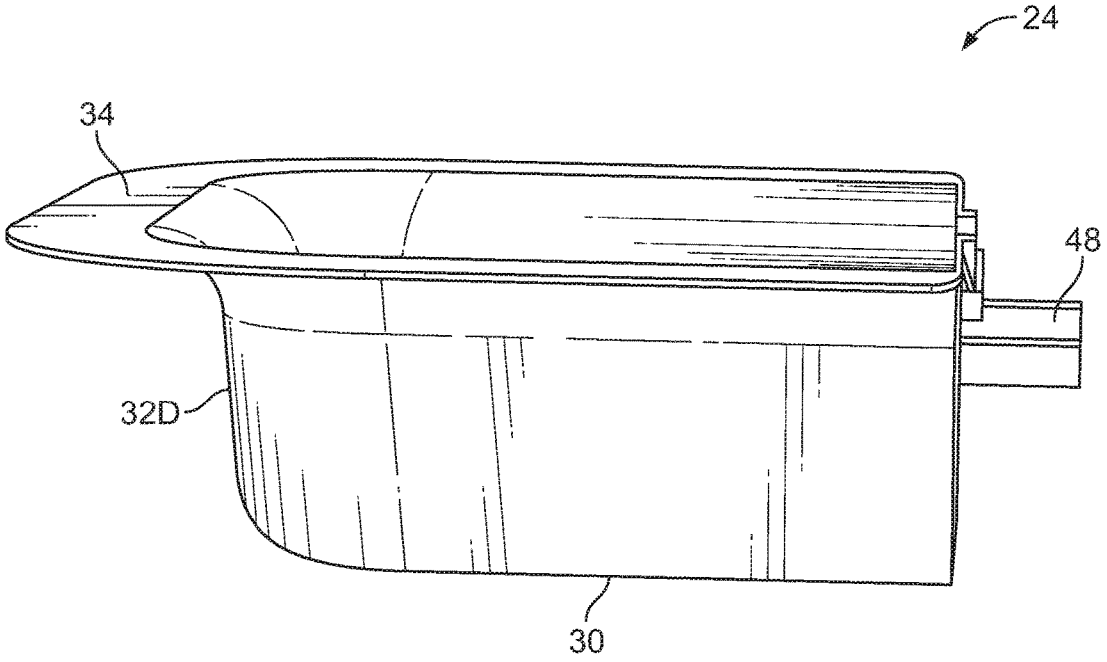
FIG. 7E illustrates a side view of the sump tray shown in FIG. 7A according to one or more embodiments shown and described herein.

Referring to FIG. 7A, an exemplary sump tray 24 of the sump base dispensing system 10 is depicted. FIGS. 7B-7E illustrate the respective back, top, bottom, and side views of the sump tray 24. The sump tray 24 is generally a square-shaped one-piece tray made of a plastic or polymer material such as polypropylene or polyethylene or the combination thereof and the like by a molding process. The molding herein refers to any thermoforming process for shaping, forming, etc., a pliable softened or melted thermoformable high impact polymer using a mold device, mold tool, (e.g., a molding die). In one embodiment, the sump tray 24 includes a base 30 having respective upstanding two side walls, front and back walls 32A, 32B, 32C, and 32D integrally attached to the base 30 to form the interior space 28. The top edges of the side walls 32A, 32B and the back wall 32D includes a mounting surface 34 extends outwardly around the rim or perimeter of the interior space 28. The mounting surface 34 is used to mount the sump tray 24 onto the recess 19 of bottom wall of the bulk bin container 14. The mounting surface 34 engages with the recess 19 formed in the bottom wall so that the sump tray 24 is hanging-down from the bottom wall via the mounting surface 34. It is within the scope of the instant disclosure that the sump tray 24 includes a different shape and/or configuration. For example, the base 30 can be inclined and/or the side walls, front and back walls 32A, 32B, 32C, 32D may be constructed with different heights. It is also within the scope of the instant disclosure to form a sump tray as an integral part of the product bag and retrofit it to the bulk bin container 14.

The sump tray 24 may include an integrated locking tongue 36 that is defined by a hinge line 38 and formed on the front wall 32C. The hinge line 38 permits a locking bracket 26 and the dispensing fitment 22 to fold back and lay down inside the interior space 28. The integrated locking tongue 36 includes a concave cutout 40 defining a first support surface 42. The first support surface 42 is configured to support the dispensing fitment 22. The integrated locking tongue 36 includes two knobs 44A, 44B each of which is formed on opposed sides of the concave cutout 40 that are used to lock the locking bracket 26 with the sump tray 24. Two tabs 46A, 46B are formed underneath of the concave cutout 40 that are used to ensure that the dispensing fitment 22 is not rotated during the dispensing operation. It should be noted that the tabs 46A, 46B are optional and they can be used if the type or shape of dispensing fitment requires its use in the dispensing operation. An arc member 48 is also formed underneath of the concave cutout 40 that is used to engage with the lock nut 23 to aide in the sump base dispensing apparatus 18 being attached to the bulk bin container 14. The arc member 48 is strategically formed at a location where it completes the circumference of the threaded ring 52 of the locking bracket 26 as will be described in greater detail hereinafter.

Figure 8A:
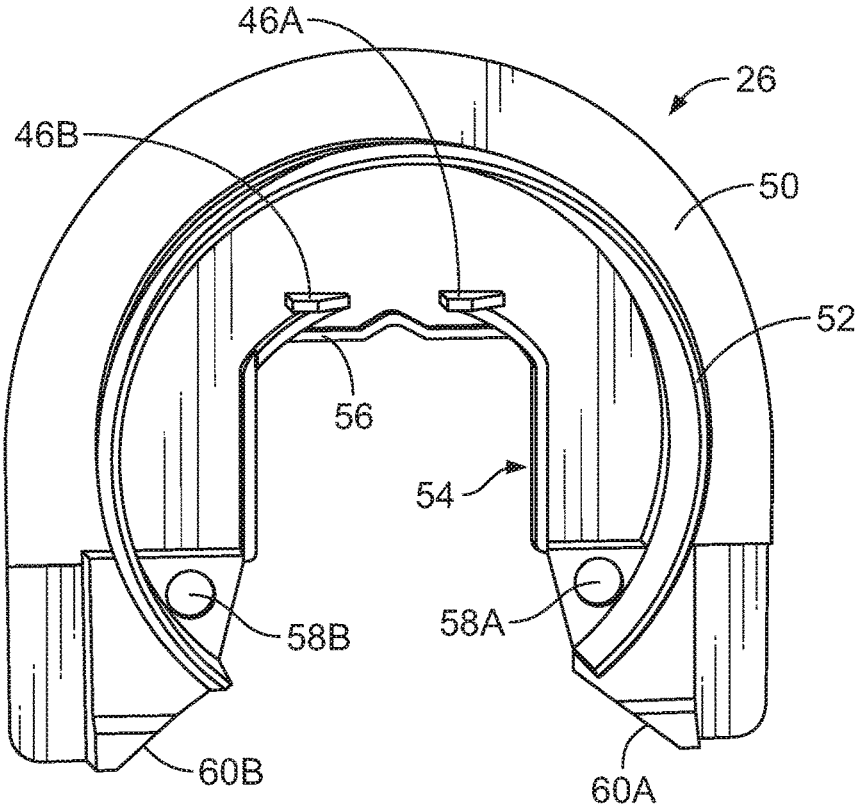
FIG. 8A illustrates a front view of a locking bracket shown in FIG. 3A according to one or more embodiments shown and described herein.
Figure 8B:
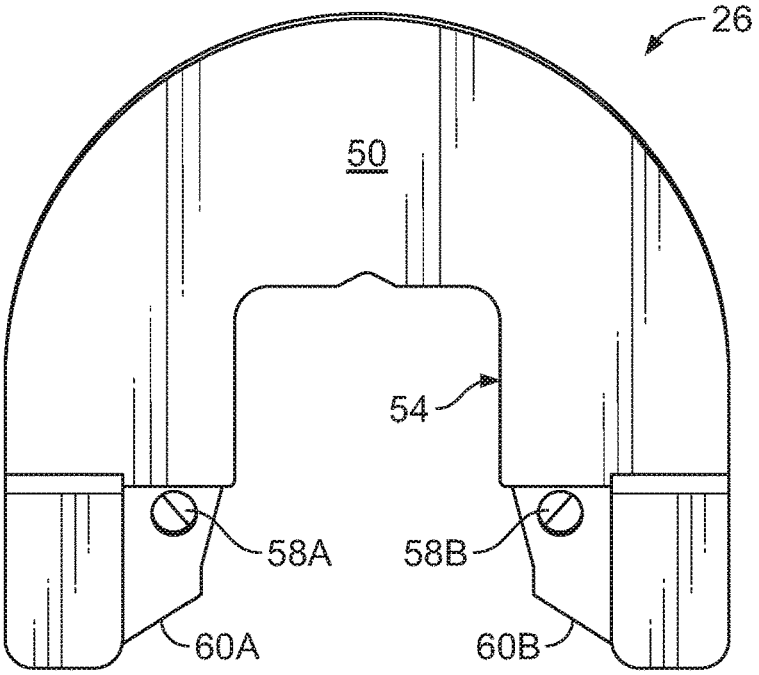
FIG. 8B illustrates a back view of the locking bracket shown in FIG. 8A according to one or more embodiments shown and described herein.
Figure 8C:
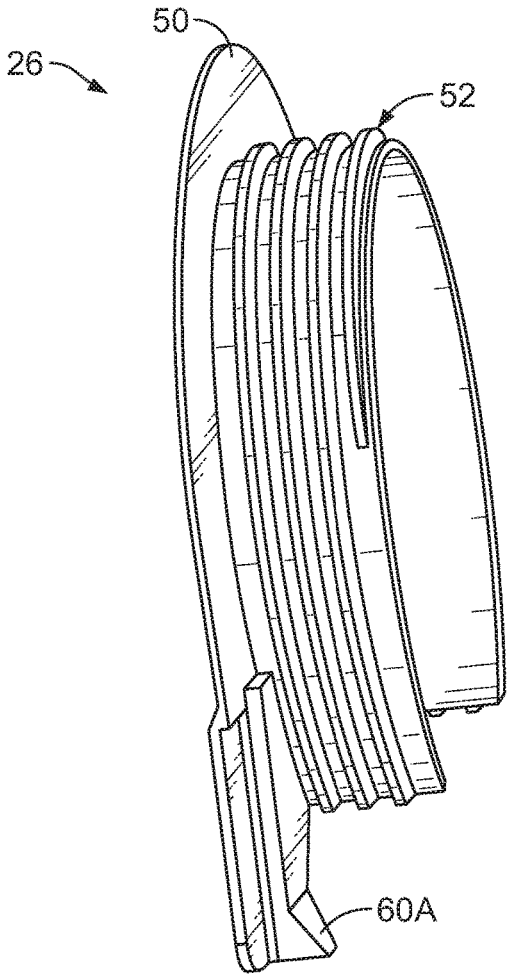
FIG. 8C illustrates a side view of the locking bracket shown in FIG. 8A according to one or more embodiments shown and described herein.
Figure 8D:
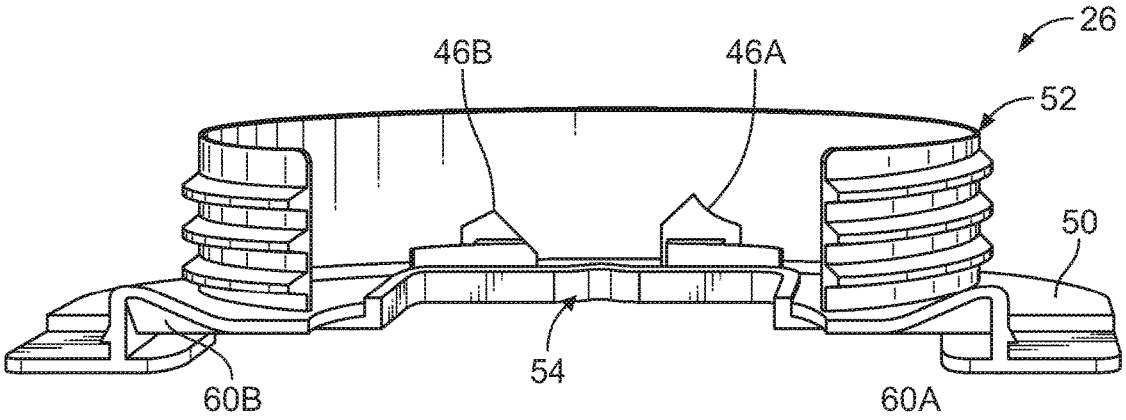
FIG. 8D illustrates a bottom view of the locking bracket shown in FIG. 8A according to one or more embodiments shown and described herein.

Referring to FIG. 8A, an exemplary locking bracket 26 is depicted. FIGS. 8B-8D illustrate respective back, side, and bottom views of the locking bracket 26 shown in FIG. 8A which are used in one embodiment of the sump base dispensing system 10. The locking bracket 26 is generally an inverted U-shaped one-piece locking bracket made of a plastic or polymer material such as polypropylene or polyethylene or the combination thereof and the likes by a molding process. The locking bracket 26 is defined by a back plate 50 having a threaded ring 52 projected outwardly thereof. The threaded ring 52 is engaged with the lock nut 23 to attach the sump base dispensing apparatus 18 to the bulk bin container 14. When the locking bracket 26 is engaged with the sump tray 24, the arc member 48 is aligned with the circumference of the threaded ring 52 in a manner that the circular lock nut 23 is securely threaded to both threaded ring 52 and the arc member 48 and therefore, the whole sump base dispensing apparatus 18 is tightly attached to the bulk bin container 14.

The back plate 50 may include a convex cutout 54 defining a second support surface 56. The second support surface 56 is configured to hold the dispensing fitment 22 in place. The back plate 50 may include two apertures 58A, 58B each of which is formed on opposed sides of the convex cutout 54 that are used to lock the locking bracket 26 to the sump tray 24. The two respective knobs 44A, 44B on the integrated locking tongue 36 are inserted to the respective apertures 58A, 58B. Two tabs 46C, 46D are formed right above of the convex cutout 54 to help prevent the dispensing fitment 22 from rotating during the dispensing operation. As noted previously, the tabs 46C, 46D are optional. The front of the inverted U-shaped back plate 50 includes respective grooves 60A, 60B which are integrally formed on opposed lower edges thereof. The grooves 60A, 60B are used to receive the respective opposed sides of the integrated locking tongue 36 as best depicted in FIGS. 4A-4D.

Figure 9A:
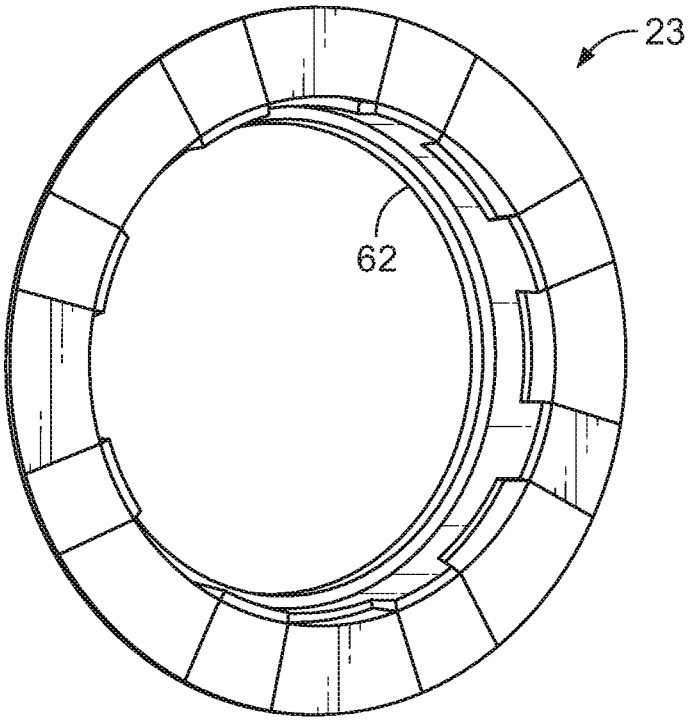
FIG. 9A illustrates a front perspective view of the lock nut shown in FIG. 4 according to one or more embodiments shown and described herein.
Figure 9B:
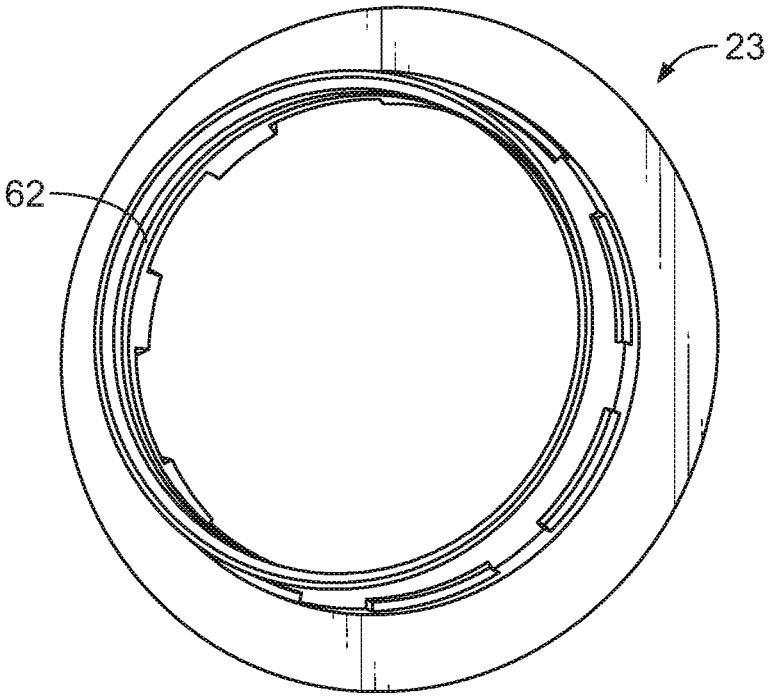
FIG. 9B illustrates a back view of the lock nut shown in FIG. 9A according to one or more embodiments shown and described herein.
Figure 9C:
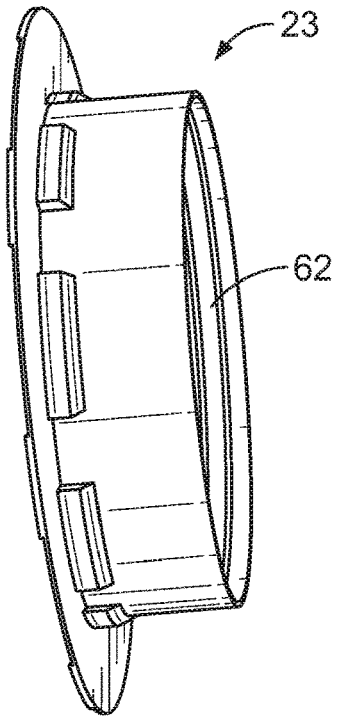
FIG. 9C illustrates a side view of the lock nut shown in FIG. 9A according to one or more embodiments shown and described herein.

Referring to FIG. 9A, an exemplary lock nut 23 is depicted. FIGS. 9B and 9C illustrate respective back and side views of the lock nut 23 shown in FIG. 9A which are used in one embodiment of the sump base dispensing system 10. The lock nut 23 is defined as a threaded flange backing ring with internal thread that is used to mate with both the threaded ring 52 and the arc member 48 so that the sump base dispensing apparatus 18 can be attached to the bulk bin container 14.

To assemble the sump base dispensing apparatus 18 to the bulk bin container 14, as described herein before, the dispensing fitment 22 is positioned onto the concave cutout 40, then the convex cutout 54 of the locking bracket 26 holds the dispensing fitment 22 in place between the respective concave and convex cutouts 40, 54 while the respective knobs 44A, 44B are inserted into the respective apertures 58A, 58B and the opposed sides of the integrated locking tongue 36 are engaged with the grooves 60A, 60B. Next, the lock nut 23 is used to mate with both the threaded ring 52 and the arc member 48 so that the sump base dispensing apparatus 18 can be attached to the bulk bin container 14.

In use, the exemplary cassette 12 may be disposed inside the bulk bin container 14 and then unfolded so that the sump base dispensing apparatus 18 can be attached to the bulk bin container 14. Next, the product bag 16 is filled with flowable material and then the bulk bin container is optionally closed at its upper end with an optional cover or lid. The filled sump base dispensing system 10 is now ready to be used or even shipped to a second customer who will dispense and use the flowable material product. This is accomplished by placing a conventional valve spigot on the dispensing fitment 22 and proceeds with dispensing the product bag 16 contents as described hereinbefore.

Figure 10A:
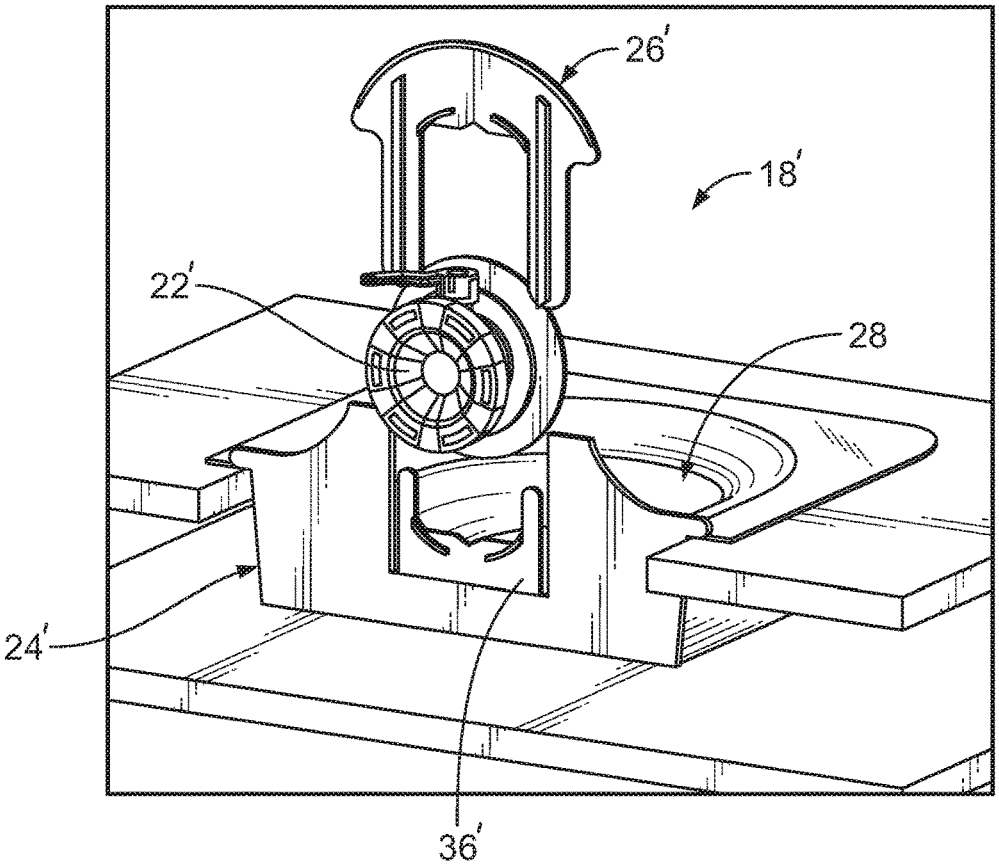
FIG. 10A illustrates an exploded top perspective view of a first alternative embodiment of a sump base dispensing apparatus and the dispensing fitment in spaced apart relationship used with the sump base dispensing system of FIG. 1 according to one or more embodiments shown and described herein.
Figure 10B:
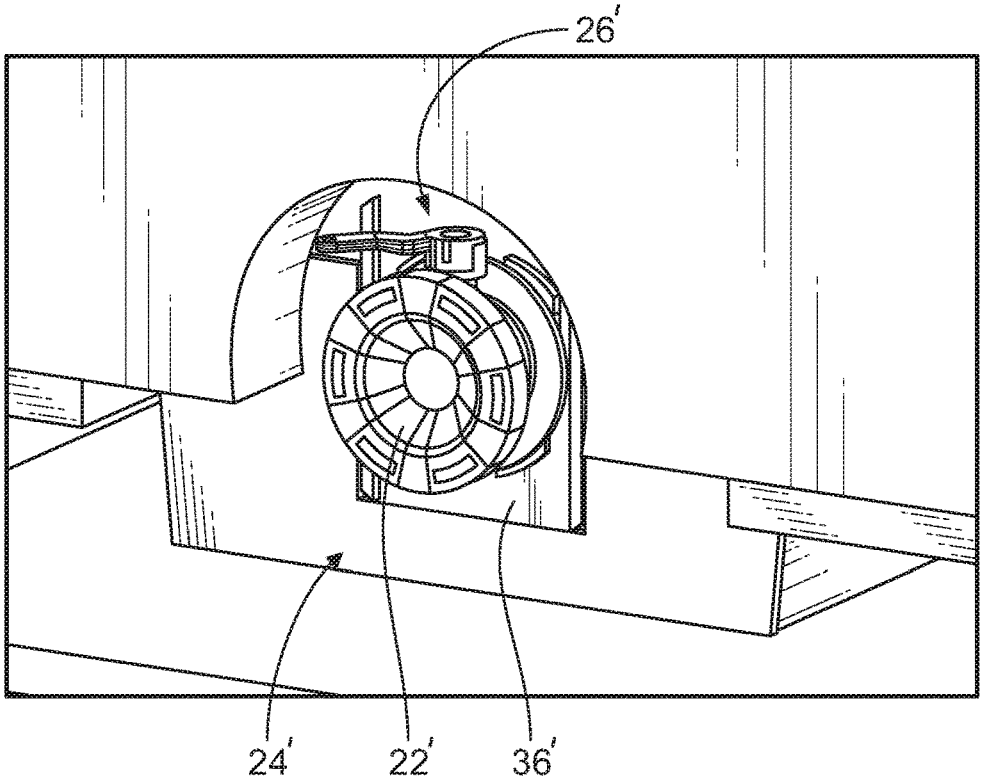
FIG. 10B illustrates the assembled top perspective view of the alternative sump base dispensing apparatus of FIG. 10A including the dispensing fitment according to one or more embodiments shown and described herein.
Figure 10C:
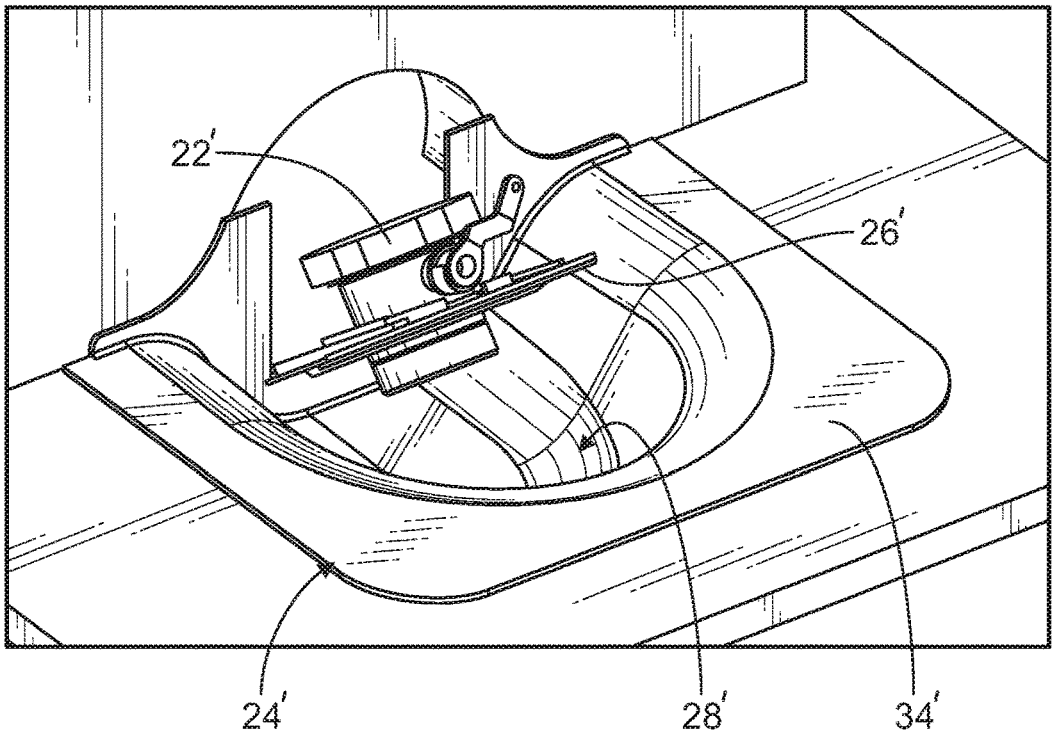
FIGS. 10C and 10D illustrate the manner in which the dispensing fitment is folding back and lay down inside the interior space of the sump tray according to one or more embodiments shown and described herein.
Figure 10D:
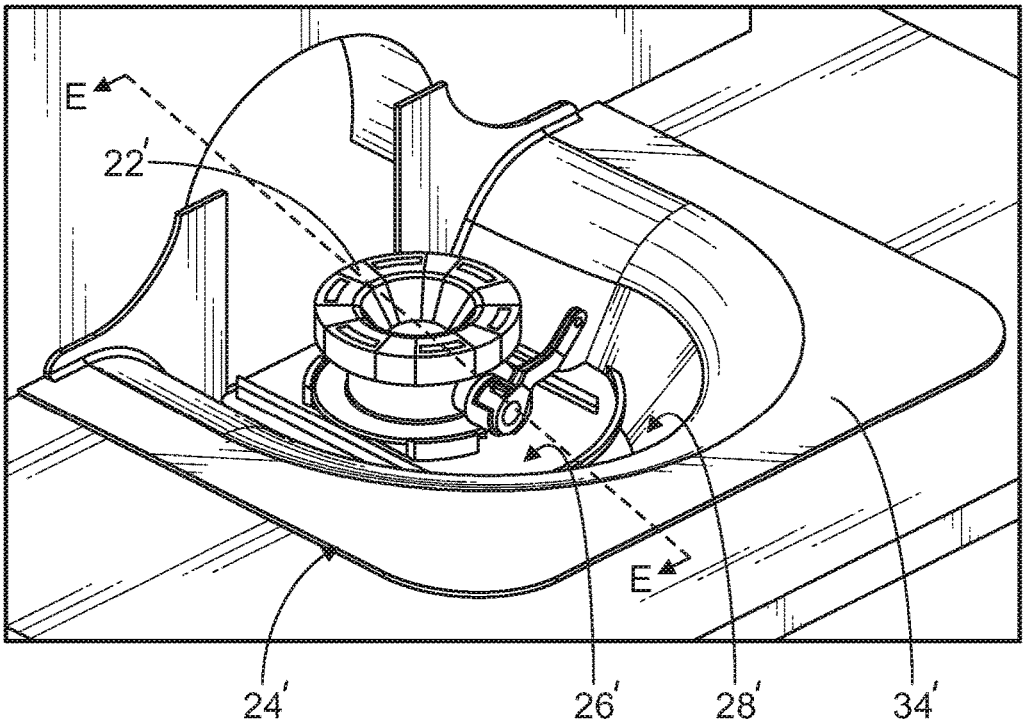

Referring to FIG. 10A, a first alternative embodiment of a sump base dispensing apparatus 18' and the dispensing fitment 22' are depicted in spaced apart relationship which are used with the sump base dispensing system 10 of FIG. 1. FIG. 10B which illustrates the fully assembled top perspective view of the alternative sump base dispensing apparatus 18' in which the dispensing fitment 22' is positioned near the bottom wall 15 of the bulk bin container 14. FIGS. 10C and 10D illustrate the manner in which the dispensing fitment 22' may fold back and lay down inside the interior space 28' of the sump tray 24' so that the alternative sump base dispensing apparatus 18' can fold freely for usage in cassettes.

Figure 10E:
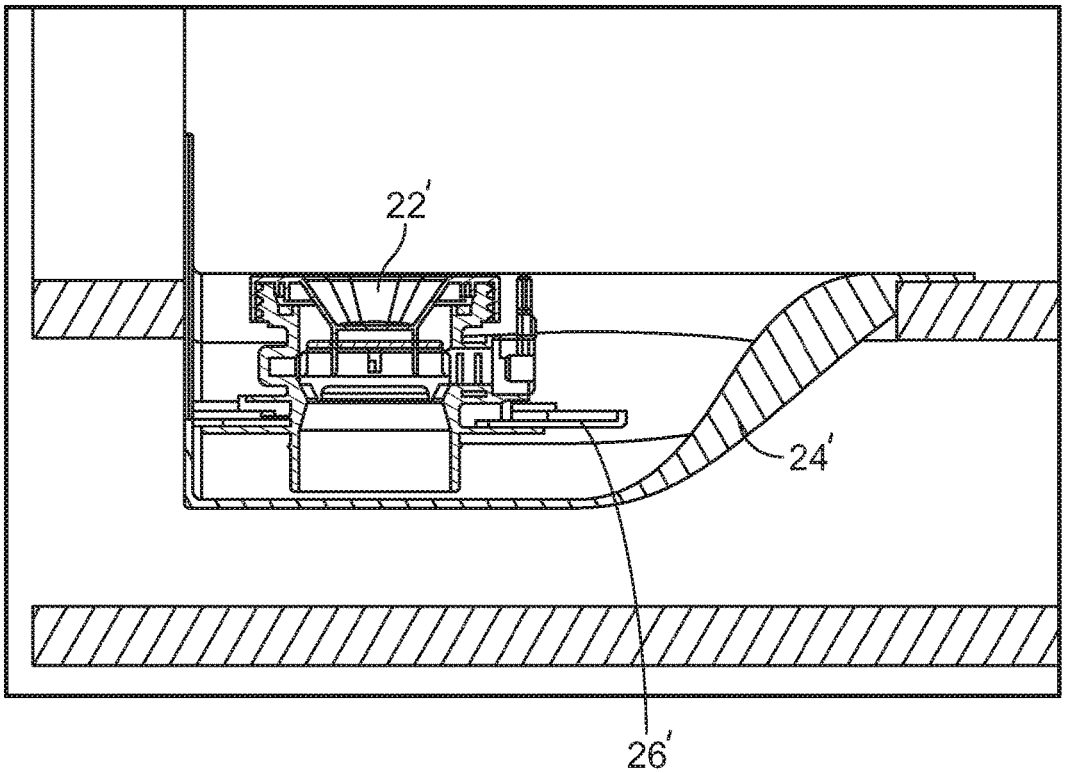
FIG. 10E illustrates a cross-sectional view of FIG. 10A taken along line E-E and illustrating the dispensing fitment positioned inside the sump tray without sticking up above the interior space according to one or more embodiments shown and described herein.

Referring to FIG. 10E which is a cross-sectional view of FIG. 10D taken along line E-E illustrating the locking bracket 26' positioned inside the sump tray 24' without sticking up above the rim of interior space 28'. The structure and operation of the respective alternative sump base dispensing apparatus 18', the locking bracket 26', and the dispensing fitment 22' are substantially the same as sump base dispensing apparatus 18, the locking bracket 26, and the dispensing fitment 22 that described with respective to FIGS. 4A-4D. For example, the general structure and operation of the sump base dispensing apparatus 18' is the same as the sump base dispensing apparatus 18 as to the manner in which the dispensing fitment 22 is engaged with the sump base dispensing apparatus 18 or 18' except that the sump base dispensing apparatus 18' does not have the respective knobs 44A, 44B and the arc member 48. Since the locking bracket 26 (shown in FIG. 8A) and the locking bracket 26' are slightly different as to means of attachment to their corresponding sump base dispensing apparatus 18 and 18', therefore the corresponding integrated locking tongues 36, 36' would be slightly different with respect to one another. However, one of ordinary skill in the art would appreciate that the principal operation and intended function of the first alternative embodiment of the sump base dispensing apparatus remains the same as the sump base dispensing apparatus that entirely described with respect to FIGS. 1-9C.

Figure 11A:
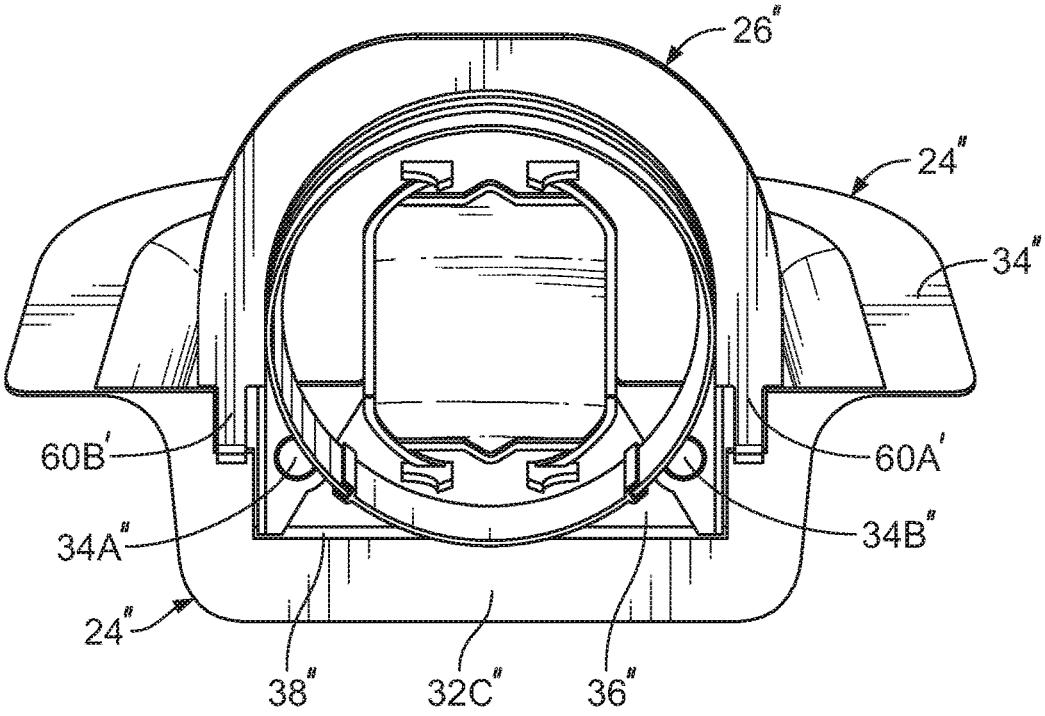
FIG. 11A illustrates a top perspective view of a second alternative embodiment of a sump tray including the locking bracket attached thereto used with the sump base dispensing system of FIG. 1 according to one or more embodiments shown and described herein.
Figure 11B:
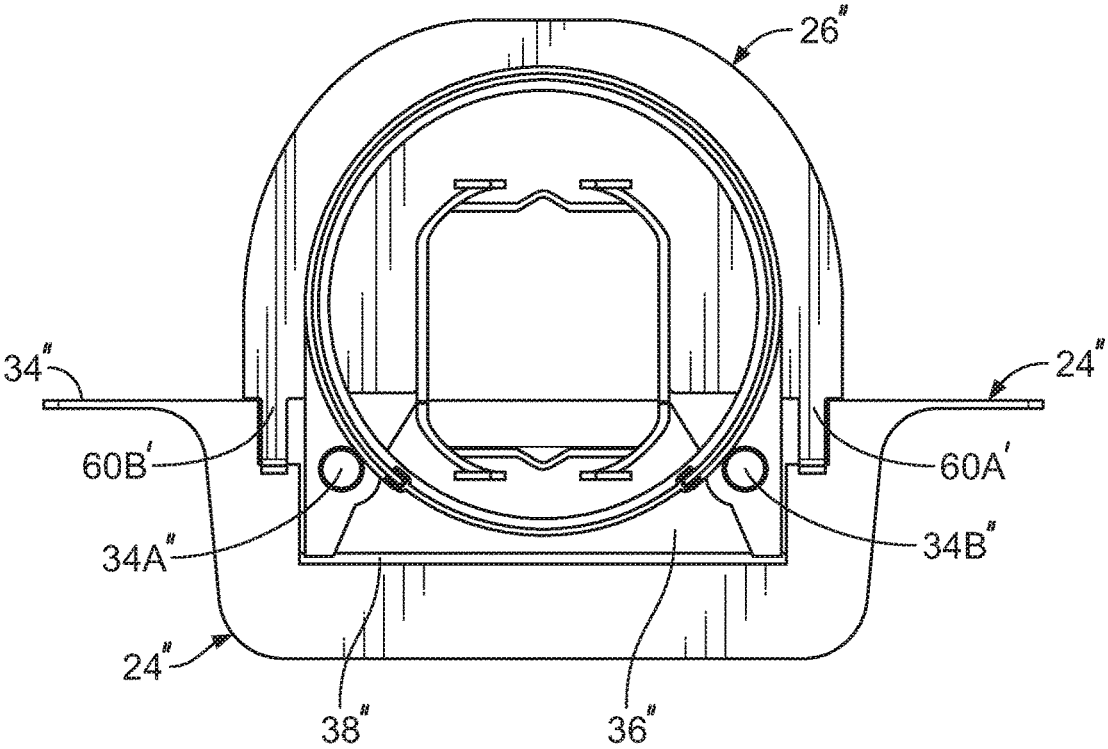
FIG. 11B illustrate a front view of the second alternative embodiment of the sump tray of FIG. 11A including the locking bracket attached thereto according to one or more embodiments shown and described herein.
Figure 11C:
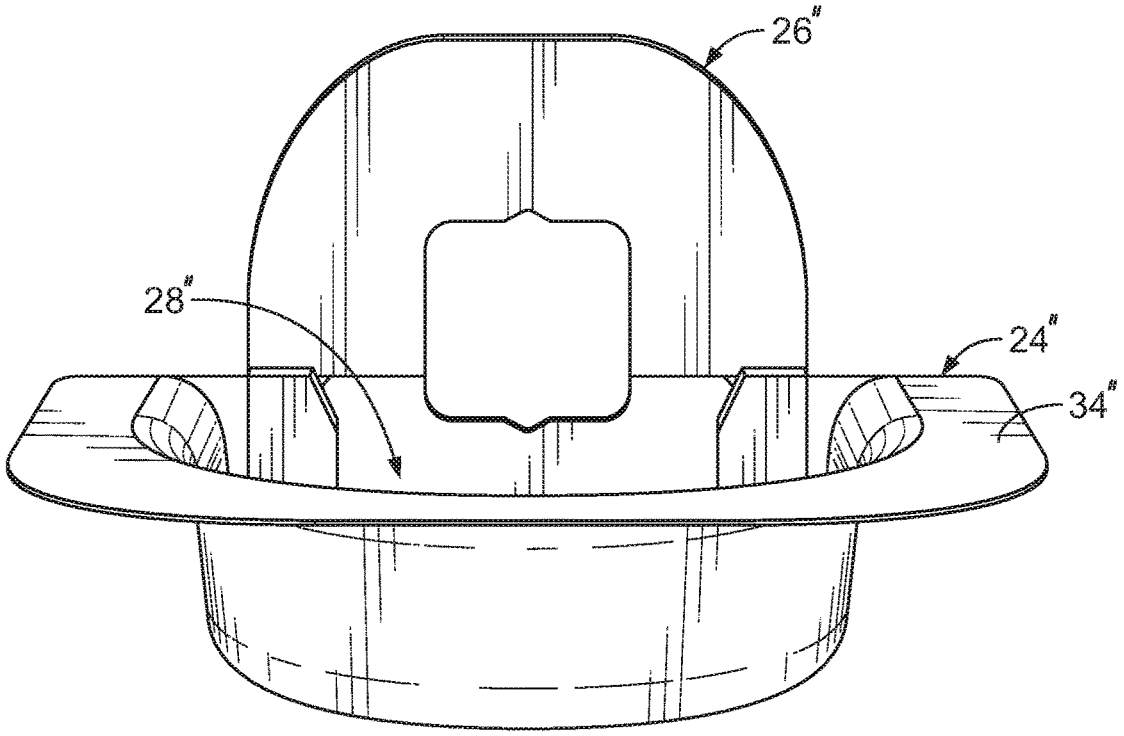
FIG. 11C illustrates a back view of the second alternative embodiment of the sump tray of FIG. 11A including the locking bracket attached thereto according to one or more embodiments shown and described herein.
Figure 11D:
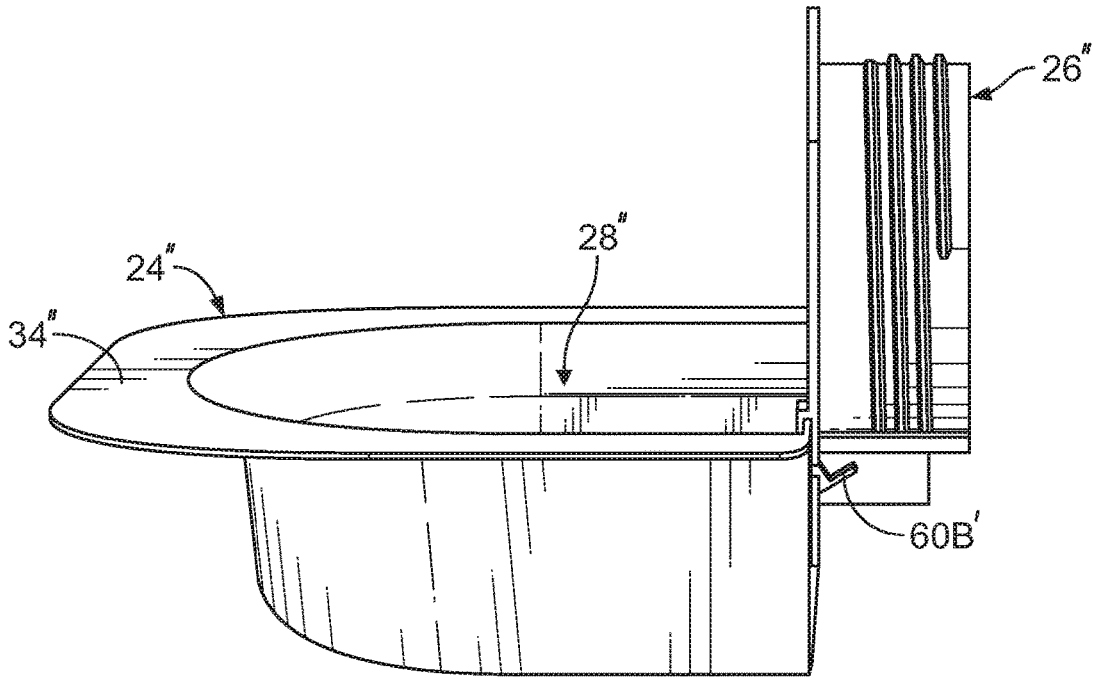
FIG. 11D illustrates a side view of the second alternative embodiment of the sump tray of FIG. 11A including the locking bracket attached thereto according to one or more embodiments shown and described herein.

Referring to FIG. 11A which is a top perspective view of a second alternative embodiment of a sump tray 24" including a locking bracket 26" attached thereto and FIGS. 8B-8D illustrate respective back, side, and bottom views of the locking bracket 26 shown in FIG. 11A which are used in one embodiment of the sump base dispensing system 10. As noted herein before, the general structure and operation of the sump tray 24" and the corresponding locking bracket 26" is the same as the sump trays 24 and 24' and the corresponding locking brackets 26, 26' except the manner in which the locking bracket 26" is attached to the sump tray 24" is slightly different. For example, the locking bracket 26" includes two grooves 60A', 60B' each of which are clipped to the sump tray 24" as depicted in FIG. 11A.

Figure 12A:
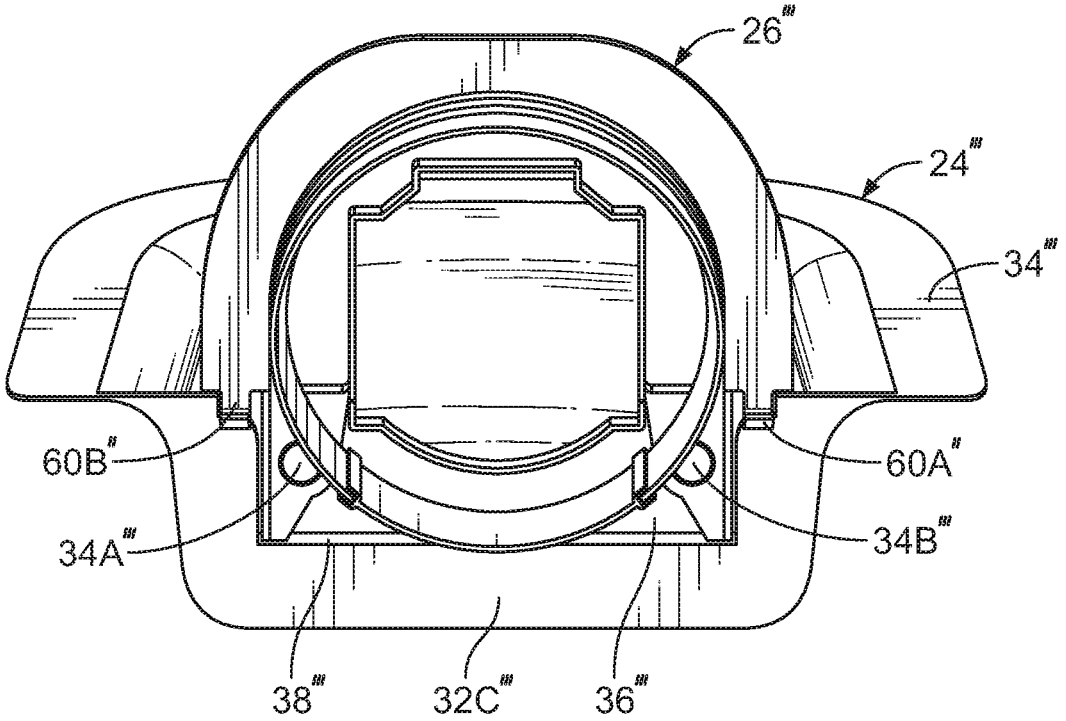
FIG. 12A illustrate a top perspective view of a third alternative embodiment of a sump base dispensing apparatus defined by a sump tray including the locking bracket attached thereto used with the sump base dispensing system of FIG. 1 according to one or more embodiments shown and described herein.
Figure 12B:
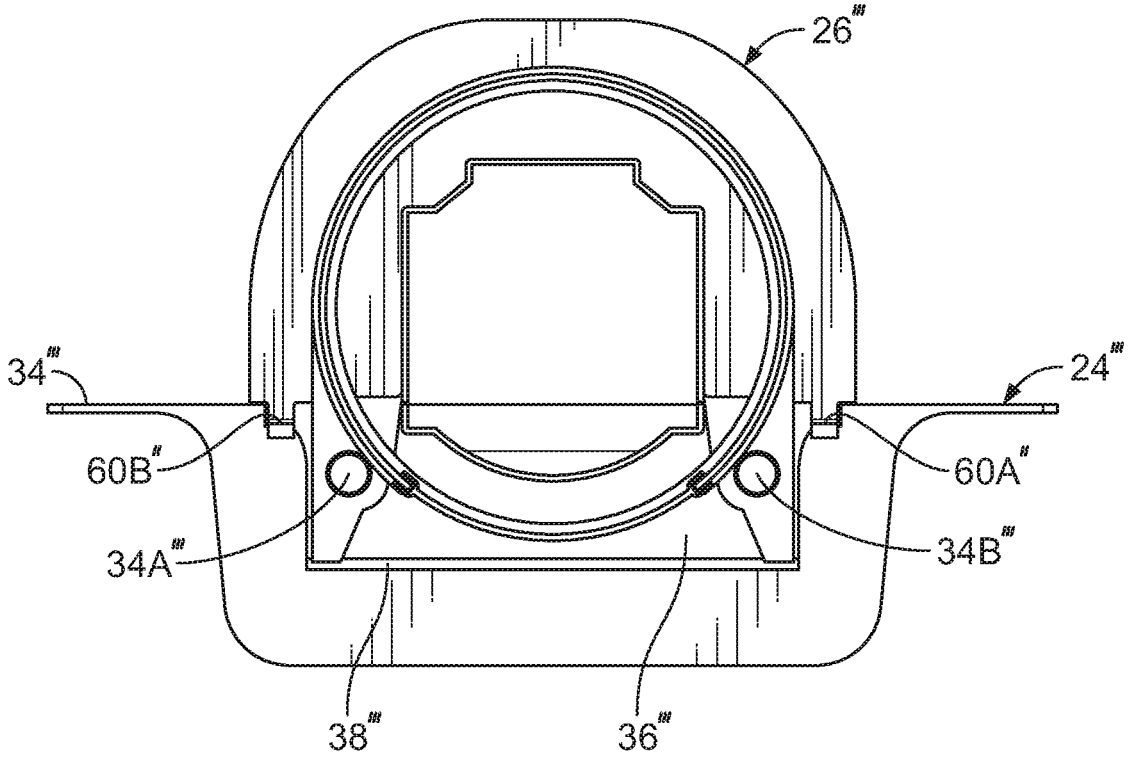
FIG. 12B illustrates a front view of the third alternative embodiment of the sump base dispensing apparatus of FIG. 12A according to one or more embodiments shown and described herein.
Figure 12C:
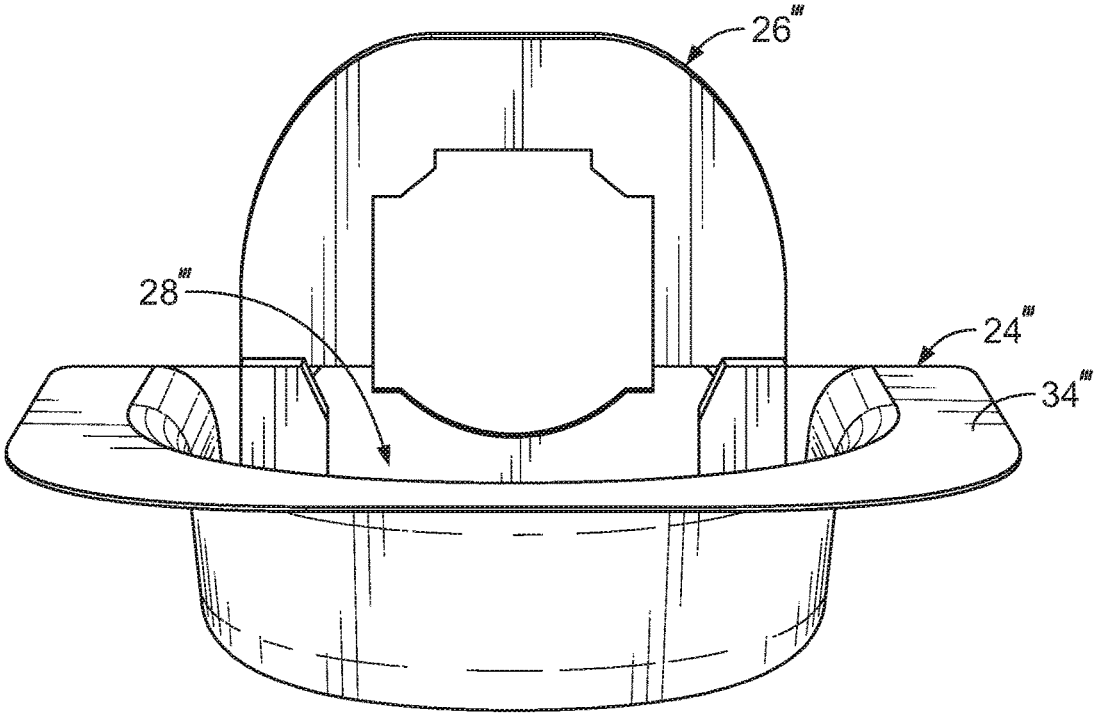
FIG. 12C illustrates a back view of the third alternative embodiment of the sump base dispensing apparatus of FIG. 12A according to one or more embodiments shown and described herein.
Figure 12D:
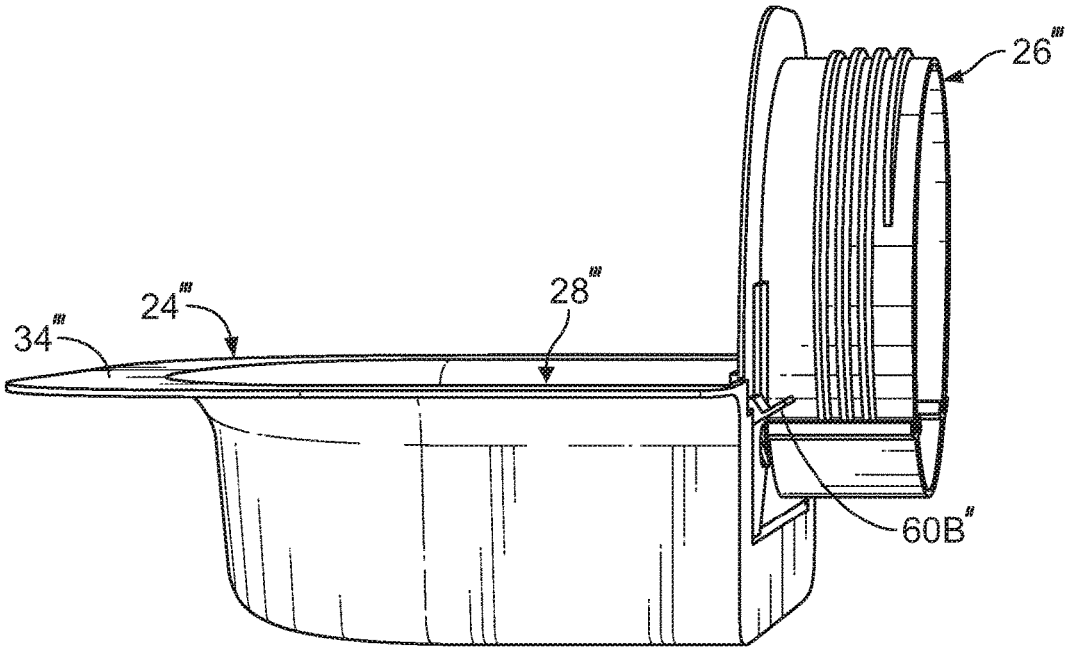
FIG. 12D illustrates a side view of the third alternative embodiment of the sump base dispensing apparatus of FIG. 12A according to one or more embodiments shown and described herein.

Finally, Referring to FIGS. 12A-12D which illustrate the third alternative embodiment of a sump tray 24''' including a locking bracket 26''' attached thereto in according to one or more embodiments shown and described herein and are used with the sump base dispensing system 10 of FIG. 1. As noted herein before, the general structure and operation of the sump tray 24''' and the corresponding locking bracket 26''' is the same as the sump trays 24, 24', 24" and the corresponding locking brackets 26, 26', 26''' except the manner in which the locking bracket 26''' is attached to the sump tray 24''' is slightly different. For example, the locking bracket 26''' includes two grooves 60A', 60B' each of which is clipped to the sump tray 24''' as depicted in FIG. 12A.

In sum, the instant disclosure is directed to a sump base dispensing system 10 comprising a bulk bin container 14 and a cassette 12. A sump base dispensing apparatus 18 comprises a sump tray 24 and a locking bracket 26 which are attached to a dispensing fitment 22, which in turn, is attached to a product bag 16. As a non-limiting example, the product bag 16 is made of flexible material such as plastic and the likes. The dispensing fitment 22 on sump base dispensing system 10 can generally be a 2" British Standard Pipe (BSP) thread, but other pipe dimensions are within the scope of the disclosure. The dispensing fitment 22 can be made of a relatively soft polyethylene material or other similar materials so that it can be welded to the polyethylene film used to construct the product bag. Although polyethylene film is used to make the product bag 16, one of ordinary skill in the art would appreciate that a variety of polymer materials can be used to construct the product bag. A lock nut 23 can be used to attach the sump base dispensing apparatus 18 to the bulk bin container 14. One of the advantages of the sump base dispensing system 10 is a combination of an assembled bulk bin container 14 and a cassette 12. The cassette 12 comprises a corrugated cassette board tray 13 that contains a product bag 16, a sump base dispensing apparatus 18, and a dispensing fitment 22 which all are concealed within the cassette board tray 13 in a flat or knock-down position. Another advantage of the instant disclosure is that the sump tray 24 includes an interior space 28 having a depth, length, and width that is constructed so that minimum amount of flowable material can be contained therein, but yet large enough to receive the combination of the dispensing fitment 22 and the locking bracket 26 in a folded position inside the interior space 28. Furthermore, the novel features of the sump tray 24 and the strategic position of sump tray 24 in the bottom wall 15 of the bulk bin container 14 assist in removing the flowable material in the product bag 16 during the dispensing of the flowable material from the bulk bin container 14. Moreover, the sump tray 24 includes an integrated locking tongue 36 that is formed on the upper portion of the front wall 32C thereof and is defined by a hinge line 38. The hinge line 38 permits the integrated locking tongue 36, the locking bracket 26, and the dispensing fitment 22 to fold back and lay down inside the interior space of the sump tray.

Accordingly, in one embodiment, a system for dispensing a flowable material is provided. The system includes a bulk bin container having a bottom wall and a plurality of upstanding side walls foldably joined to the bottom wall to form an interior space. One of the pluralities of the side walls includes a dispensing opening. A cassette is configured to be disposed into the interior space and is positioned within the bottom wall of the bulk bin container. The cassette includes a product bag having a respective inlet and outlet ports used for respective filling and dispensing the flowable material from the product bag. A sump base dispensing apparatus is configured to be attached to the product bag via a dispensing fitment so as to assist in removing the flowable material through the dispensing fitment by gravity force.

In another embodiment, a system for dispensing flowable material from a bulk bin container is provided. The system includes a bulk bin container having a bottom wall and a plurality of upstanding side walls foldably joined to the bottom wall to form an interior space. The bottom wall includes a recess formed therein and one of the plurality of the side walls includes a dispensing opening. A product bag is configured to be disposed into the interior space of the bulk bin container. The product bag includes a respective inlet and outlet ports used for respective filling and dispensing the flowable material from the product bag. A dispensing fitment is attached to the outlet port and is inserted into the dispensing opening of the bulk bin container. A sump base dispensing apparatus is configured to be attached to the dispensing fitment. The sump base dispensing apparatus includes a sump tray and a locking bracket in which the sump tray is configured to be mounted in a hanging-down position from the recess of the bulk bin container. The locking bracket is configured to be attached to the sump tray via the dispensing fitment held therebetween so as to assist in removing the flowable material through the dispensing fitment by gravity force.

In a further embodiment, a cassette kit for a bulk bin container for dispensing flowable material is provided. The kit includes a cassette board tray and a product bag that is removably attached to the cassette board tray. The product bag includes a respective inlet and outlet ports used for respective filling and dispensing the flowable material from the product bag. A dispensing fitment is attached to the outlet port and a sump base dispensing apparatus is configured to be attached to the product bag via the dispensing fitment so as to assist in removing the flowable material through the dispensing fitment by way of gravity force.

In yet another embodiment, a sump base dispensing kit for a bulk bin container and bag combination for dispensing flowable material is provided. The kit includes a sump tray and a locking bracket that is attached to the sump tray. The sump tray is configured to be mounted in a hanging-down position from a recess in the bulk bin container and the locking bracket is configured to be attached to the sump tray with a dispensing fitment held therebetween so as to assist in removing the flowable material through the dispensing fitment by gravity force.

While this instant disclosure is susceptible of embodiment in many different forms, there is shown, in the drawings, several specific embodiments with the understanding that the instant disclosure is to be considered as an exemplification of the principles of the embodiments and is not intended to limit the instant disclosure to the embodiments illustrated. It will be understood that like or analogous elements and/or components, referred to herein, are identified throughout the drawings by like reference characters. In the instant disclosure, the use of prime character in the numeral references in the drawings directed to the different embodiment indicate that those elements are either the same or at least function the same. In addition, it will be understood that the drawings are merely representations of the instant disclosure, and some of the components may have been distorted from actual scale for purposes of pictorial clarity.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system for dispensing a flowable material comprising:

a bulk bin container having a bottom wall and a plurality of upstanding side walls foldably joined to the bottom wall to form an interior space and wherein one of the plurality of the side walls includes a dispensing opening; and a cassette being configured to be disposed into the interior space and being positioned on the bottom wall of the bulk bin container, the cassette comprises a product bag having a respective inlet and outlet ports used for respective filling and dispensing the flowable material from the product bag, and a sump base dispensing apparatus being configured to be attached to the product bag via a dispensing fitment so as to assist in removing the flowable material through the dispensing fitment by gravity force, the sump base dispensing apparatus includes a sump tray and a locking bracket that is used to securely hold in place the dispensing fitment and an integrated locking tongue defined by a hinge line formed on an upper portion of a front wall of the sump tray wherein the hinge line permits the locking bracket and the dispensing fitment to fold back and lay down inside of the interior space of the sump tray.

2. The system of claim 1 wherein the bottom wall of the bulk bin container includes a recess formed therein for mounting the sump base dispensing apparatus thereto.

3. The system of claim 1 further comprising a lock nut used to attach the sump base dispensing apparatus to the bulk bin container.

4. The system of claim 1 wherein the cassette further comprising a foldable cassette board tray that is used to receive both of the product bag and the sump base dispensing apparatus therein.

5. The system of claim 4 wherein the product bag and the sump base dispensing apparatus are concealed inside the cassette when the foldable cassette board tray is in a folded or knocked down position.

6. The system of claim 4 wherein the product bag is adhesively attached to the foldable cassette board tray.

7. The system of claim 1 wherein the sump tray includes a base having respective upstanding side, front and back walls each of which integrally attached to the base to form an interior space.

8. The system of claim 7 wherein the side walls and the back wall includes a mounting surface extending outwardly from top edges, the side walls, and the back wall around a rim or perimeter of the interior space of the sump tray and wherein the mounting surface is used to securely hold the sump tray in a hanging-down position from the bulk bin container.

9. The system of claim 1 wherein the integrated locking tongue includes a concave cutout defining a first support surface configured to support the dispensing fitment.

10. The system of claim 9 wherein the integrated locking tongue further includes two knobs each of which is formed on opposed sides of the concave cutout that are used to lock the locking bracket to the sump tray.

11. The system of claim 10 wherein the two respective knobs on the integrated locking tongue are inserted to the respective apertures.

12. The system of claim 9 wherein the integrated locking tongue further includes an arc member formed underneath of the concave cutout used to engage with the lock nut so that the sump base dispensing apparatus is attached to the bulk bin container.

13. The system of claim 12 wherein the locking bracket is defined by a back plate having a threaded ring projected outwardly thereof and wherein the threaded ring is engaged with a lock nut to attach the sump base dispensing apparatus to the bulk bin container.

14. The system of claim 13 wherein the back plate includes a convex cutout defining a second support surface and wherein the second support surface is configured to securely hold the dispensing fitment.

15. The system of claim 14 wherein the back plate includes two apertures each of which is formed on opposed sides of the convex cutout that are used to lock the locking bracket to the sump tray.

16. The system of claim 13 wherein the back plate includes two respective grooves each of which is integrally formed on opposed lower edges thereof and wherein the respective two grooves are used to receive the respective opposed sides of the integrated locking tongue.

* * * * *